US009255415B2

(12) United States Patent
Gregersen

(10) Patent No.: US 9,255,415 B2
(45) Date of Patent: Feb. 9, 2016

(54) BINDING APPARATUS

(75) Inventor: Johan C. Gregersen, Bagsværd (DK)

(73) Assignee: JBJ Mechantronic APS, Gentofte (DK)

( * ) Notice: Subject to any disclaimer, the term of this patent is extended or adjusted under 35 U.S.C. 154(b) by 834 days.

(21) Appl. No.: 13/322,328

(22) PCT Filed: May 27, 2010

(86) PCT No.: PCT/EP2010/057331
§ 371 (c)(1),
(2), (4) Date: Jan. 19, 2012

(87) PCT Pub. No.: WO2010/136530
PCT Pub. Date: Dec. 2, 2010

(65) Prior Publication Data

US 2012/0118176 A1 May 17, 2012

Related U.S. Application Data

(60) Provisional application No. 61/181,431, filed on May 27, 2009, provisional application No. 61/296,742, filed on Jan. 20, 2010.

(30) Foreign Application Priority Data

May 27, 2009 (EP) ..... 09161234
Jan. 20, 2010 (EP) ..... 10151193

(51) Int. Cl.

| | |
|---|---|
| ***B65B 13/22*** | (2006.01) |
| ***B65B 13/28*** | (2006.01) |
| ***B21F 15/04*** | (2006.01) |
| ***E04G 21/12*** | (2006.01) |

(52) U.S. Cl.
CPC ..... *E04G 21/122* (2013.01); *B21F 15/04* (2013.01); *B65B 13/22* (2013.01)

(58) Field of Classification Search
CPC ..... B65B 13/22; B65B 13/28; H02G 1/00; E04G 21/123; B21F 15/04
USPC ..... 100/2, 29, 32, 31, 33 R, 33 PB; 140/93.2, 140/93.4, 93.6, 93 A, 118, 119, 123.5, 140/123.6; 53/399, 582, 589
See application file for complete search history.

(56) References Cited

U.S. PATENT DOCUMENTS

| | | | | |
|---|---|---|---|---|
| 4,117,872 | A * | 10/1978 | Gott et al. | 140/57 |
| 4,252,157 | A * | 2/1981 | Ohnishi | 140/93 A |
| 4,362,192 | A | 12/1982 | Furlong et al. | |
| 5,657,799 | A | 8/1997 | Kusakari et al. | |
| 5,947,166 | A * | 9/1999 | Doyle et al. | 140/119 |

(Continued)

FOREIGN PATENT DOCUMENTS

| | | |
|---|---|---|
| CN | 1068305 A | 1/1993 |
| CN | 1761796 A | 4/2006 |
| EP | 0 332 532 A1 | 3/1989 |

(Continued)

*Primary Examiner* — Jimmy T Nguyen
(74) *Attorney, Agent, or Firm* — Muncy, Geissler, Olds & Lowe, P.C.

(57) ABSTRACT

A binding apparatus for binding a wire around one or more objects is provided. The binding apparatus is adapted to bind the wire such that a predetermined tension in the wire is achieved. A method of binding a wire around one or more objects so as to achieve a desired tension of the wire in the binding is also provided.

7 Claims, 10 Drawing Sheets

(56) References Cited

U.S. PATENT DOCUMENTS

| | | | | |
|---|---|---|---|---|
| 5,983,473 | A * | 11/1999 | Yuguchi et al. | 29/33 F |
| 2004/0140384 | A1 * | 7/2004 | Goodley | 242/118 |

FOREIGN PATENT DOCUMENTS

| | | | |
|---|---|---|---|
| EP | 0708214 | A1 | 4/1996 |
| EP | 0 731 238 | A1 | 9/1996 |
| EP | 0 751 270 | A1 | 1/1997 |
| EP | 0 810 153 | A1 | 12/1997 |
| EP | 0 822 304 | A1 | 2/1998 |
| EP | 0 829 596 | A1 | 3/1998 |
| EP | 1484249 | A1 | 12/2004 |
| GB | 2 358 154 | A | 7/2001 |
| JP | 2008-156870 | A | 7/2008 |
| RU | 38729 | U1 | 2/2004 |
| WO | WO-00/36249 | A1 | 6/2000 |
| WO | WO 01/94206 | A1 | 12/2001 |
| WO | WO 2004/083559 | A1 | 9/2004 |
| WO | WO-2007/141822 | A1 | 12/2007 |
| WO | WO-2009/065775 | A1 | 5/2009 |

* cited by examiner

BINDING APPARATUS

CROSS REFERENCE TO RELATED APPLICATIONS

This application is a 371 of International Application No. PCT/EP2010/057331, filed May 27, 2010, for which priority is claimed under 35 U.S.C. §120; and this application claims priority of Application No. 09161234.1 filed in Europe on May 27, 2009, and Application No. 10151193.9 filed in Europe on Jan. 20, 2010 under 35 U.S.C. §119; and this application claims priority of U.S. Provisional Application No. 61/181,431 filed on May 27, 2009, and U.S. Provisional Application No. 61/296,742 filed on Jan. 20, 2010 under 35 U.S.C. §119(e), the entire contents of all of which are hereby incorporated by reference.

FIELD OF THE INVENTION

The present invention relates to a binding apparatus for binding a wire around one or more objects. In particular the present invention relates to a binding apparatus wherein a wire is automatically guided around the object(s).

BACKGROUND OF THE INVENTION

Binding reinforcement bars in concrete constructions is known to be a costly operation. By manual processes a wire is curled around the reinforcing bars, and by means of a wire cutter, the free ends of the wire are twisted such that the reinforcing bars are tied together.

Resent considerations not only related to the costs of binding the bars but also related to the working environment, has lead to the development of hand-held, portable devices for binding.

EP 0751270 shows a device for binding reinforcement bars for concrete constructions. The device operates by twisting a wire in a loop by a guide arm. A hook thereby binds the reinforcement bars together by twisting the wire loop.

U.S. Pat. No. 4,252,157 shows a device for binding reinforcement bars, comprising a differential gear for transferring torque from a motor to a binding head and a cutting device, respectively.

EP 1 484 249 discloses a reinforcing bar machine comprising three motors: a feeding motor, a twisting motor and a sliding motor. The feeding motor forms part of a feeding mechanism and is used to feed the wire. A binding wire twisting mechanism includes the twisting motor and the sliding motor.

Further examples of known binding apparatuses are disclosed in U.S. Pat. No. 5,657,799, EP 0 731 238, EP 0 810 153, EP 0 332 532, EP 0 829 596, U.S. Pat. No. 4,362,192, EP 0 751 270, U.S. Pat. No. 4,252,157, and WO 0194206.

It has been found that the ability of the binding apparatus to provide the desired tension in the bound wire is critical for the quality of the binding. If the wire is tensioned too much, the wire may rupture, whereby the user must repeat the binding action hoping that the second binding does also not rupture. If on the other hand the binding is too loose, the binding will most likely not serve its purpose which in many cases is to ensure that two reinforcing bars are forced into contact with each other.

With regard to the twisting of the wire by the binding apparatus, binding apparatuses normally are based on one of two principles. A first in which the wire is twisted as many times as possible e.g. until wire is pulled out of the binding apparatus or until a predetermined torque is reached during the binding process. In a second principle the wire is twisted a predetermined number of times.

One advantage of twisting the wire a predetermined number of times is that the binding time for each binding is held at a minimum. The reason for this is that in the "as many times as possible" process, an excessive amount of wire is often provided in order to ensure that the wire ends are twisted a sufficient number of times so as to ensure a desired strength of the binding. The effect is that the ends must be twisted a large number of times which is time consuming.

However, when the wire is twisted a predetermined number of times, it is difficult to achieve the same tightness of the binding, as the wire path around the reinforcing bare varies from binding position to binding position. In a grid of vertical and horizontal bars, the bars most often will not define a right angle in each intersection—even when this is intended. These small angular variations between intersecting bars make it difficult to provide the same tension in the wire in each binding. The result is that the bindings are either too loose or breaks because they are too tight. Another reason for loose or breaking bindings is that reinforcing bars on their outer surface often are provided with rips/protrusions for mechanically binding the reinforcing bars to the concrete. The ribs/protrusions are spaced apart along the outer surface of the reinforcing bars and depending on the position of the binding relative to the adjacent ribs/protrusions, the wire path may be longer or shorter.

Accordingly, it is an object of an embodiment of the present invention to provide an apparatus that twists the wire a predetermined number of times while it at the same time provides the desired tension in the bindings irrespective of the number of objects to be bound and/or their thickness and/or the number of ribs and/or the position of the ribs relative to the binding.

Moreover, it is an object of an embodiment of the present invention to provide a binding apparatus which reduces the risk of rupture of the wire during binding.

Furthermore, it is an object of an embodiment of the present invention to provide a binding apparatus with which the risk of loose bindings is reduced or even eliminated.

BRIEF DESCRIPTION OF THE INVENTION

In a FIRST aspect, the present invention relates to a binding apparatus for binding a wire around one or more objects, the binding apparatus defining:

- a wire path for guiding a wire around the objects;
- a wire supply for advancing the wire into the wire path; and
- a binding tool adapted to retain two ends of the wire relative to the binding tool and to rotate the ends relative to the wire path whereby the ends of the wire are twisted around each other, thus causing the wire to bind the objects together, wherein the binding apparatus is adapted to bind the wire such that a predetermined tension in the wire is achieved.

One advantage of ensuring a predetermined tension in the wire is that the binding is tight enough while at the same time the wire does not break during the binding process.

In one embodiment, the binding apparatus further comprising one or more space defining elements adapted to space the objects apart from the binding tool. Moreover, the space defining elements may be adapted to vary the distance from the objects to the binding tool in response to at least one of:

- the torque transferred from the binding tool to the wire during binding,
- the axial pressure on the space defining element, and
- the axial tension in wire during binding.

When the space defining element(s) is/are adapted to vary the distance from the objects to the binding tool in response to the torque transferred from the binding tool to the wire during binding, then distance may start to be varied when the torque reaches a level of 0.1 Nm, such as 0.2 Nm, such as 0.3 Nm, such as 0.4 Nm, such as 0.5 Nm, such as 1 Nm.

Additionally, when the space defining element(s) is/are adapted to vary the distance from the objects to the binding tool in response to the axial pressure on the space defining element, then the distance may start to be varied when the axial pressure on the space defining element is above 100 Newton, such as 200 Newton, such as 300 Newton, such as 400 Newton, such as 500 Newton, such as 600 Newton, such as 700 Newton.

Additionally, when the space defining element(s) is/are adapted to vary the distance from the objects to the binding tool in response to the axial tension in wire during binding, then the distance may start to be varied when the axial tension in wire—during binding—100 Newton, such as 200 Newton, such as 250 Newton, such as 300 Newton, such as 400 Newton, such as 500 Newton, such is above 600 Newton.

In one embodiment, the apparatus is adapted to twist the ends around each other a predetermined number of times, such as one time, such as two times, such as three times, such as four times, such as five times or any number of times there above. In the present, context the wire is twisted one time if the two wire ends are rotated 360 degrees relative to and around each other. It will be appreciated that in some embodiments, the wire ends may be twisted any multiplum of 360 degrees different from 360 degrees times an integer. As an example the wire ends may be twisted 1.5 times 360 degrees i.e. 540 degrees.

The width of the reinforcing bars and the position of the wire relative to the protrusions on the outer surface of the reinforcing bars determine how much wire remains to be twistable once the wire has been guided around the reinforcing bars. If the reinforcing bars are wide/thick, a shorter piece of wire remains to be twistable. Accordingly, the provision of a space defining element which is adapted to vary the distance from the objects during the binding process allows for a larger part to the wire to be accessible for twisting. In particular this feature allows for the wire to be twisted the predetermined number of times, e.g. two times, independent on the width of the reinforcing bars and/or the position of the protrusions on the outer surface of the reinforcing bars relative to the wire.

In one embodiment, one space defining element is provided. Alternatively, two or more space defining elements may be provided such as two, three, four, five or six space defining elements.

The space defining element(s) may be movable from a distal position and towards a proximal position or even into said proximal position. The distance travelled by the space defining elements when moved from the distal to the proximal position may be in between 5 mm and 50 mm, such as 50 mm, such as 15 mm such as 20 mm such as 30 mm such as 40 mm. The path along which each of the space defining elements travel during movement between its distal and its proximal position may be linear or curved. The latter case may be achieved by arranging the space defining elements pivotally.

In one embodiment, a distal protrusion is may be provided for preventing the space defining element from being biased past the distal position. Similarly, proximal protrusion may be provided for preventing the space defining element from being moved past its proximal position. Accordingly, the space defining element is movable between the distal and the proximal protrusions.

In one embodiment, the space defining element is movable from a distal position relative to the binding tool and towards a binding tool, moreover the space defining element may be biased towards the distal position. The space defining element may be biased towards the distal position by means of at least one of: a resilient element, a pneumatic arrangement and a hydraulic arrangement, an electrical motor, or any other biasing means. The resilient element may be a tension element or a compression element or a torsional element, such as a tension or compression or torsional spring. In one embodiment, the resilient element is an elastic member made out of rubber—synthetic or natural. In one embodiment, the resilient element is a cantilever spring or a helical spring. The pneumatic arrangement may comprise one or more pneumatic cylinders. Similarly, the hydraulic arrangement may comprise one or more hydraulic cylinders.

The biasing means may have a spring constant which determines the force with which the space defining element is biased towards the distal position. In one embodiment, the spring constant is in the range 5-50 N/mm, such as 10 N/mm, such as 12 N/mm, such as 14 N/mm, such as 16 N/mm, such as 18 N/mm, such as 20 N/mm, such as 25 N/mm, such as 30 N/mm, such as 35 N/mm, such as 40 N/mm, such as 45 N/mm.

In one embodiment, the spring constant is chosen such that if the binding apparatus is positioned on top of the reinforcing bars in a position in which the apparatus is allowed to rest on the reinforcing bars, then the weight of the binding apparatus will cause an insignificant movement of the space defining element away from its distal position. An insignificant movement will in one embodiment mean that the space defining element remains in physical contact the distal protrusion. In another embodiment, the insignificant movement shall be construed such that space defining element has moved less than 1 percent of the distance between its distal and proximal position.

In some embodiment, it may be desirable to be able to vary the distal position. This is especially the case if the reinforcing bars to be bound changes from begin very wide to being very thin and vice versa.

Accordingly, the distal position of the space defining element may be adjustable by means of an adjusting arrangement. In one embodiment, the adjusting arrangement comprises an adjustment plate adapted to adjust the distance from the binding head to the distal position of the space defining element. The adjustment plate may be adapted to be interposed between the space defining element(s) and the binding apparatus. In one embodiment, binding apparatus comprises a plurality of interchangeable adjustment plates, each of which is adapted to provide different distal positions of the space defining element.

The thickness of the adjustment plates may be 1 mm, such as 2 mm, such as 3 mm, such as 4 mm, such as 5 mm, such as 6 mm, such as 7 mm, such as 8 mm, such as 8 mm, such as 10 mm, such as 11 mm, such as 12 mm, such as 13 mm, such as 14 mm, such as 15 mm, such as 16 mm, such as 17 mm, such as 18 mm, such as 19 mm, such as 20 mm, such as 22 mm, such as 24 mm, such as 26 mm, such as 28 mm, such as 30 mm, such as 32 mm, such as 34 mm, such as 36 mm, such as 38 mm, such as 40 mm, such as 42 mm, such as 44 mm, such as 46 mm, such as 48 mm, such as 50.

It will be appreciated that the thicker the adjustment plate is, the further the reinforcing bars are spaced apart form the binding tool, and thus the longer is the ends which are used to bind the wire. Additionally it will be appreciated that the thinner the adjustment plate is, the closer the reinforcing bars are to the binding tool and the shorter is thus the wire ends.

During use, the user can choose the adjustment plate which yields the desired tension in the wire during binding. It will be appreciated that the thicker the reinforcing bars are, the longer must be the pieces of wire which are twisted during binding in order to achieve the desired number to twists during binding. Additionally, it will be appreciated that the thinner the reinforcing bars are, the shorter need the wire ends be in order to be able to achieve the desired number of twists of the wire ends.

In an alternative embodiment, the distal position may be adjustable by means of a handle which is coupled to a mechanism such that when the handle is turned, the distal position is changed. In one embodiment, the handle takes the form of a ring shaped element accessible from the outer surface of the device. The mechanism may comprise a threaded member which is rotatable by means of the handle and which when rotated causes the distal position to be changed.

In an alternative embodiment, the adjustment arrangement comprises at least one of a hydraulic means for adjusting the distal position, a pneumatic means for adjusting the distal position and an electrical means for adjusting the distal position. The hydraulic means may be a hydraulic cylinder. The pneumatic means may be a pneumatic cylinder. The electrical means may be a linear actuator. It will be appreciated that when pneumatic means may used to adjust the distal position, the entire binding apparatus may be fluidly coupled to a pneumatic source. In the latter embodiment, any motor of the binding apparatus may be a pneumatic motor.

The binding apparatus may be adapted to slacken the wire prior to twisting depending on the width of the reinforcing bars. Accordingly, in one embodiment, the binding apparatus comprises a retainer for retaining a front end of the wire, and the wire supply is adapted to:

- advance the front end of the wire into the wire path such that the wire is guided around the objects and the front end is received in the binding tool and is retained therein by the retainer;
- tighten the wire; and
- slacken the wire depending on the length of the tightened wire and/or the size of the objects such that:
  - the degree of slackening of the wire is the lowest, if the wire has a first length and/or the objects have a first size,
  - the degree of slackening of the wire is the highest, if the wire has a second length and/or the objects have a second size, and
  - the degree of slackening of the wire is between said lowest and highest slackening, if the wire has a third length and/or the objects have a third size, wherein the first length is shorter than the second length which is shorter than the third length, and wherein the first size is smaller than the second size which is shorter than the third size.

By providing an apparatus which adjusts the tension in the wire in accordance with the length of the wire to be bound and/or the size of the objects to be secured together, the correct tension may be achieved. Thus the resulting binding will not be too loose or too tight.

The inventors have surprisingly found that in order to achieve the desired tension, the needed degree of slacking/loosening of the wire is not linearly dependent on the length of the wire or the size of the objects to be bound. In fact, the inventors have found that medium length wires must be slackened more than both short and long wires.

In the content of the present invention the term "tighten" shall be understood such that the length of the wire which encirculates the objects to be bound is made shorter i.e. the binding apparatus pulls in one of the ends of the wire. Contrary hereto the term "slacken" shall—in the context of the present invention—be understood such that the length of the wire which encirculates (is guides around) the objects to be bound is made longer as the binding apparatus feeds/advances more wire "into" the encirculating part of the wire.

In one embodiment, the degree of slackening is measured in percent of the length of the wire which encirculates the objects to be bound. In another embodiment, the degree of slackening of the wire is measured in millimeters.

Accordingly in one embodiment, the 'slackening the wire' shall be understood in the following manner:

- slacken the wire depending on the length of the tightened wire and/or the size of the objects such that:
  - the wire is slackened a length or percentage A, if the wire has a first length and/or the objects have a first size,
  - the wire is slackened a length or percentage B, if the wire has a second length and/or the objects have a second size, and
  - the wire is slackened a length or percentage C, if the wire has a third length and/or the objects have a third size, wherein $A<C<B$, and wherein the first length is shorter than the second length which is shorter than the third length, and wherein the first size is smaller than the second size which is shorter than the third size.

Alternatively, or as a supplement, the wire supply may be adapted to

- advance the front end of the wire into the wire path such that the wire is guided around the objects and the front end is received in the binding tool and is retained therein by the retainer;
- tighten the wire;
- determine the length of the wire which is guided around the objects to be bound, and
- slacken the wire in response the length of the wire which is guided around the objects to be bound.

Alternatively, or as a supplement, the wire supply may be adapted to slacken the wire depending on the length of the tightened wire and/or the size of the objects such that:

- the degree of the slackening of the wire is in a lower range, if the wire has a length which is below a first length-threshold and/or the objects have a size which is below a first size-threshold,
- the degree of slackening of the wire is in a middle range, if the wire has a length which is above a third length-threshold and/or the objects have a size which is above a third size-threshold, and
- the degree of slackening of the wire in an upper range, if the wire has a length which is between the first and third length-threshold and/or the objects have a size which is between the first and third size-threshold, wherein the first length-threshold is below the third length-threshold and the first size-threshold is below the third size-threshold, and wherein the wire is slackened less in the lower range than in the middle range and more in the upper range than in the middle range.

Examples of the first length-threshold are five centimeters, six centimeters, seven centimeter, eight centimeters, nine centimeters, ten centimeters, eleven centimeters, twelve centimeters, thirteen centimeters or any other value.

Examples of the third length-threshold are ten centimeters, eleven centimeters, twelve centimeter, thirteen centimeters, fourteen centimeters, fifteen centimeters, sixteen centimeters, seventeen centimeters, eighteen centimeters or any other value.

In one embodiment, the degree of slackening of the wire is in the middle range, if the wire has a length which is between the first and a second length-threshold and/or the objects have a size which is between the first and a second size-threshold and wherein:

the first length-threshold is below the second length-threshold, and the second length-threshold is below the third length-threshold, and the first size-threshold is below the second size-threshold, and the second size-threshold is below the third size-threshold.

In the latter embodiment, the degree of slackening is in the lower range when the wire is below the first length-threshold, in the middle range when the wire in between the first and the second length-threshold, in the upper range when the wire in between the second and the third length-threshold and in the middle range when the wire is above the third length threshold.

Alternatively, or as a supplement, the degree of slackening may be in the lower range when the objects have a size below the first size-threshold, in the middle range when the objects have a size between the first and second size-threshold, in the upper range when the objects have a size between the second and third size-threshold and in the middle range when the objects are above the third size-threshold.

In the context of the present invention the size of the objects to be bound may be the diameter of the smallest circle encircling the objects. Alternatively, the size may be the longest dimension of the objects in a cross-section to the objects. Alternatively, the size may be the area or circumference of the aforementioned circle.

In one embodiment, the degree of slackening is defined by a table comprising empiric data. Such a table may in one embodiment comprise two columns. A first containing rows each with a different length of the wire in the tightened state, and a second column containing corresponding degrees of slackening of the wire for the respective length of wire. The degree of slackening may be in percent or in millimeters. Thus in each row is specified a length of the tightened wire (the first column in the row) and the corresponding degree of slackening (the second column in the row).

Alternatively, or as a supplement, the wire supply may be adapted to slacken the wire on the basis of a polynomial in which at least one indeterminate is the length of the tightened wire or the size of the objects. This could be a polynomial of a fourth degree e.g. on the formula $ax^4+bx^3+cx^2+dx+e$, where x is the size of the objects or the length of the wire and a, b, c, d, and e are constants. Alternatively, the polynomial is a fifth degree, a sixth degree, seventh degree etc. polynomial.

In one embodiments where the apparatus comprises the aforementioned adaptive space defining elements (which are adapted to vary the distance from the objects), the slackening function may be linear i.e. such the wider the objects to be bound are the more the wire is slackened after having been tightened.

In one embodiment, the function used to slacken the wire may be a one-to-one function. In the present context a "one-to-one function" shall be understood as a function defining a relation of x,y where for every x there is one and only one value of y assigned, and at the same time for every y there is one and only one value x. One example of such a function is a linear function e.g. $y=ax+b$.

In one embodiment, the binding tool comprises:

a binding head, and an inner tool member slidingly received in the binding head such that the inner tool member and the binding head are locked for relative rotation, the inner tool member being connected to a rotatable spindle such that rotation of the spindle causes the inner tool member to move, axially relative to the binding head, in the direction of a locking position in which the inner tool member is locked for axial movement relative to the binding head, whereby further rotation of the spindle causes concurrent rotation of the inner tool member and the binding head in a first direction relative to the wire path.

In one embodiment, the binding apparatus comprises a means for determining the tension of the wire. This could be a means for determining the torque during applied to the wire during the binding process. Once the torque has reached a predetermined value, the binding process may be halted as the desired tension in the wire is achieved.

In one embodiment, the binding apparatus defines a wire path for guiding a wire around one or more objects. In this embodiment the binding apparatus comprises:

a wire supply for advancing the wire into the wire path; and a binding tool forming a passage for the wire into and out of the wire path and being rotatable relative to the wire path, and comprising:

a binding head, and an inner tool member slidingly received in the binding head such that the inner tool member and the binding head are locked for relative rotation, the inner tool member being connected to a rotatable spindle such that rotation of the spindle causes the inner tool member to move, axially relative to the binding head, in the direction of a locking position in which the inner tool member is locked for axial movement relative to the binding head, whereby further rotation of the spindle causes concurrent rotation of the inner tool member and the binding head in a first direction relative to the wire path.

The concurrent movement of the inner tool member and the binding head in the first direction relative to the wire path, causes the free ends of a wire piece, which have been guided around the objects by the binding apparatus, to be twisted relative to each other, whereby the wire piece is bound around the object(s). Prior to and/or during said binding process, the wire may be tightened/tensioned such that a tight binding may be provided, i.e. a binding wherein the objects are forced towards each other due to the tensioned wire piece.

At least a part of the binding apparatus may comprise a plastic material such as a reinforced plastic material, metal material such as an acid proof material, a fibre glass material, or any other material suitable to be used in a concreting environment.

The binding apparatus may be used to bind any two (or more) objects together, such as reinforcing bars, tree branches, plastic tubes e.g. heating tubes for floor heating systems, wires etc. As an example, the binding apparatus may be used to secure an element to a larger structure, such as fastening an electrical wire to a structure in order to secure the wire in a predetermined position. It will be appreciated that the binding apparatus may also be used to bind a wire to a single object, e.g. so as to provide a coat-hook or a handle or so as to mark a position on the object.

The wire may be any wire suitable for binding, such as a metal wire e.g. coated with a non-metal material, or a plastic wire or any other wire suitable to be used in the binding apparatus. In one embodiment, the wire may be any wire which is sufficiently rigid to be reshaped/bent to have a predetermined curvature and to maintain said curvature for a period of time of at least 30 seconds, such as 1 minute, such as 2 minutes, such as 5 minutes.

In use, the wire may be provided on a roll which may be inserted into the wire supply, such that the wire may be feed into the binding head during binding of the wire. The wire supply may comprise a motor coupled to feeding rollers for feeding/advancing the wire into the binding head. In one embodiment, the apparatus comprises one set of rollers (each set comprising two opposing rollers between which the wire is provided). In another embodiment, the apparatus comprises plurality of sets of rollers such as two, such as three, such as four, such as five.

The wire supply may comprise one or more sensors such as photo-sensors or mechanical-sensors, for detecting the position of the wire. As an example, a sensor may be provided upstream (relative the feeding direction of the wire) of the feeding rollers such that upon manual insertion of a wire into the wire supply, the rollers may be activated upon detection of a wire by the upstream sensor. When the manually inserted wire meets the rotating rollers, the rollers continue the advancement of the wire until the supplied wire ends.

Moreover, a sensor may be provided downstream the feeding rollers, and the distance between the upstream and the downstream sensors may correspond to the minimum length a wire must have in order to be guided around and bound to one or more objects. Thus, upon user activation of the apparatus, the apparatus may be adapted to determine whether the wire is sufficiently long to perform a binding action, and may prevent the process in case the wire is not sufficiently long.

Either or both of the upstream and downstream sensors may be magnetic sensors arranged to detect the presence of the wire. It will be appreciated, that in order for magnetic sensor to be able to detect the wire, the wire must comprise a magnetic material such a ferromagnetic material. As mentioned above the sensor(s) may be any kind of sensor(s) such as photo-sensors, mechanical-sensors.

Alternatively, or as a supplement, the binding apparatus may comprise a revolution counter adapted to count the number of revolutions made by the feeding rollers. As one revolution of the feeding rollers corresponds to a predetermined length of wire, the revolution counter may be adapted to output a signal corresponding to a wire length. As the rollers are in direct contact with the wire, determination of the number of revolutions will provide a direct measure of the length of the wire which is advanced.

In one embodiment the apparatus comprises a revolution counter and the aforementioned upstream sensors. In the latter embodiment, the apparatus may be adapted to be operated as follows: If during feeding of wire, the upstream sensor is no longer able to detect the wire i.e. the wire supply is empty, the apparatus may, by means of the revolution counter, be adapted to determine the length of the wire which, in connection with the current binding action, has already been feed by means of the rollers. If said length is below a predetermined length e.g. the length needed to perform a binding action, the binding apparatus may be adapted to retract the feed wire and signal to the user, that the wire is not long enough for binding and that a new wire should be inserted into the wire supply.

In one embodiment, the binding apparatus comprises the revolution counter and is adapted to determine the total length of wire already used and the length of the wire remaining in the wire supply. Moreover, the binding apparatus may be adapted to calculate the number of bindings which may be performed by means of the wire remaining in the wire supply. Additionally, the binding apparatus may be adapted to determine an average time elapsing between each binding, and, thus, the time left until the wire must be changed. The latter information may be used by the user to determine whether the remaining wire is long enough to continue until the next break or until the end of the working day.

In one embodiment, the apparatus is adapted to determine/calculate the amount of wire which is needed, and on the basis thereof operate the wire supply such that once the wire has been tightened, the wire is slackened so as to achieve the desired tightness of the wire. It will be appreciated that the tighter the binding is, the more prone the wire/binding will be to breaking/rupturing. Additionally it will be appreciated that the looser the binding is, the higher is the risk that the elements to be bound may move relative to each other in the area of the binding.

In one embodiment the apparatus comprises a processor for controlling one or more of the motors and the sensors. The processor may comprise a memory for storing information. In one embodiment, the processor is adapted to control the motor for feeding the wire, such that the wire is loosened to the desired extend prior to the tying process.

Moreover, a table may be stored in the memory, which table comprises information as to the degree of loosening depending on the length of the wire. The information stored in the table may be stored into the memory prior to the sale of the product e.g. during manufacture. Alternatively, or as a supplement, the user may store the information into the memory during use of the device such that the wire is tightened at a level desired by the user.

In one embodiment, the information is determined by the manufacturer as a result of empiric tests. In yet another embodiment, the processor is adapted to loosen the wire based on a formula such as a formula which approximately provides the same result as the values determined empirically.

The wire supply may be adapted to advance the wire into the wire path, which is the path along which the wire is guided from the binding tool, around the object(s) and back to the binding tool. Said path may be defined by one or more of: a first passage of the binding head, a second passage of the binding head, a first guiding jaw and a second guiding jaw, as is described in further detail below.

The inner tool member is slidingly received in the binding head and may be moved between an initial position and a locking position. When the inner tool member is positioned in the initial position, it may be moved in a first direction, relative to the binding head, whereby it is moved towards the locking position. When inner tool member is positioned in the locking position it is locked for further movement in the first direction, relative to the binding head, but may be moved in the opposite direction, i.e. in the direction of the initial position.

In order to achieve that rotation of spindle causes the inner tool member to move translationally, the inner tool member may be threadedly connected to the spindle, e.g. by means of a single thread or a multiple thread comprising two, three, four five, six, seven or eight threads. In one embodiment, an inner surface of the inner tool member is threaded and arranged to engage a threaded outer surface of the spindle. Alternatively, an inner surface of the spindle may be threaded and arranged to engage a corresponding threaded outer surface of the inner tool member. At least one of the threads may be an ISO-metric thread, a square thread, or a trapezium thread or any other thread suitable to transform the rotation of the spindle to a translational movement of the inner tool member. In one embodiment, the inner tool member is connected to the spindle by means of a ball screw assembly and/or a roller screw.

The binding apparatus may comprise a motor for rotating the spindle. The motor may be an electrical motor and the binding apparatus may comprise a power supply such as a battery, for providing power to the electrical motor. Alternatively, the binding apparatus may comprise a cable for connecting the apparatus to mains or an external battery. The motor may be connected directly to the spindle or via one or more gears.

When the spindle is rotated at least a part of the torque is transferred to the inner tool member, which, thus, must be locked for rotation in order to achieve the translational movement. Accordingly in one embodiment, the binding head, relative to which the inner tool member is locked for rotation, may be partly locked for rotation in a first direction. By partly locked for rotation is meant that the binding head is prevented from rotating in the first direction unless a torque applied to the binding head is above a predetermined threshold. In one embodiment, an adjustable spring determines the predetermined threshold. The spring may be adjustable by the user.

Moreover, the binding head may be locked for rotation in a direction opposite the first direction, relative to the wire path, whereby rotation of the spindle in the opposite direction causes the inner tool member to be moved away from the locking position and towards the initial position.

The binding tool may define a first passage defining an inlet and an outlet, and a second passage defining an outlet. In one embodiment, the wire supply is adapted to advance the wire through the first passage by advancing the wire into the inlet and out of the outlet, and back into the inlet of the second passage so as to guide the wire around the object(s). During movement between the outlet of the first passage and the inlet of the second passage, the wire may follow the wire path.

The binding apparatus may comprise a cutting tool which is arranged to cut the wire during movement of the inner tool member towards the locking position. In one embodiment, the tool member is adapted to cut the wire inside the first passage or in an area of the inlet of the first passage. The cutting tool may comprise a first cutting edge which during cutting is moved towards either a second cutting edge or a contact surface, through a substantially non-rotational movement, such as a substantially pure translational movement in the direction of the locking position. The first cutting edge and one of the second cutting edge and the contact surface may be adapted to be moved directly towards each other or may be arranged to slide past each other like the cutting edges of a scissor. When the a wire is inserted through the first passage and received in the second passage, cutting of the wire causes a piece of wire to be separated from the wire of the wire supply. Said wire piece comprises a cut end and a feed/fed end. Subsequently to the cutting action, the cut end may be positioned in the first passage or in the area of the inlet of the first passage, and the feed/fed end may be positioned in the second passage. In an embodiment, the first cutting edge is defined by the inner tool member. In a further embodiment, the second cutting edge or the contact surface may be defined by a guiding member for guiding the wire into the first passage.

In order to ensure that the wire which has passed through the first passage is received in the second passage, at least a part of the wire part may be defined by one or more guiding jaws. In one embodiment, the binding apparatus comprises at least one of a first and a second guiding jaw. The first and second guiding jaws may be spaced apart such that an object to be bound may be inserted into a cavity defined by the first and second guiding jaw, e.g. by moving the binding apparatus in over the object(s). Due to the gap between the first and second guiding jaw, the first guiding jaw may be adapted to guide a wire from the first guiding jaw to the second guiding jaw. During use, the feed/fed end of the wire is feed from the outlet of the first passage on to a first guiding surface of the first guiding jaw, upon further feeding of the wire the feed/fed end slides along the first guiding surface and leaves the first guiding jaw whereby the feed/fed end is advanced in free air. However, due to the shape of the first guiding jaw/surface, the feed/fed end of wire is guided in the direction of the second guiding jaw and finally received in by the second guiding jaw. Subsequently, the second guiding jaw guides the feed/fed end into the inlet of the second passage.

In one embodiment, at least one of the first and second guiding jaw is adapted to be rotated between a first and a second position such that when positioned in the first position, an object to be tied is encircled by the binding apparatus and such that when positioned in the second position an object to be tied may be advanced into a binding position by being moved through a passage defined between end surfaces the first and second guiding jaws. Each of the rotatable guiding jaws may be biased towards the first position and may comprise means for forcing it into the second position. Such means may be an inclined surface provided at the end surfaces of the first and/or the second guiding jaw.

Moreover, the first and/or second guiding jaws may be releasable reattachable to the binding apparatus, so as to allow a user to replace jaws.

The first and second passage may be arranged with respect to each other, such that a wire feed out of the first passage must be reshaped, such as bend, in order to be received in the second passage. Accordingly, at least a part of the wire path may be defined by a shaping tool adapted to shape the wire when advanced through the shaping tool, so as to allow the wire to be received in the second passage of the binding tool. The shaping tool may be defined by one or more of the binding tool and the first guiding jaw. In order to reshape/bend the wire, the shaping tool may comprises at least three shape-defining surfaces which are arranged with respect to each other, such that the wire is formed so as to have with a predetermined curvature, when the feed/fed end of the wire is moved translationally into the shaping tool. In one embodiment, at least one shape-defining surface is movable in relation to at least one other shape-defining surface, so as to change the curvature of a wire feed through the shaping tool. At least one of the inner tool member, the binding head and the first guiding jaw, may define at least one guiding surface adapted to guide the wire from the wire supply and into the shaping tool.

In order to allow the wire to be tightened around the object(s) the shaping tool may be shaped such that upon tightening of the wire, the wire is brought out of engagement with the shaping tool, whereby the wire may be tightened around at least a part of the one or more objects. In one embodiment, the shaping tool may comprise a pawl mechanism allowing the wire to be brought out of engagement with the shaping tool. In another embodiment tightening of the wire causes the wire to be moved sideward's out of engagement with the shaping tool as is described in further detail in the description of the figures.

When the feed/fed end has been received in the second passage, the binding apparatus may be adapted to tighten the wire. Accordingly, to prevent that said tightening of the wire causes the feed/fed end to be pulled out of the second passage, the second passage may comprise a retainer for preventing movement of the feed/fed end in a direction opposite the insertion direction. As the second passage is at least partly defined by the binding tool, the retainer, the inner tool member and/or the binding head comprise(s) the retainer. However subsequent to binding the wire piece, the feed/fed end should preferable be moved out of engagement with the retainer and, thus, the retainer may be adapted to allow the feed/fed end to be (re)moved in a direction transverse to the insertion direction, whereby the feed/fed end is moved out of engagement with the retainer. In one embodiment the removal direction defines an angle of 45-90 degrees relative to the insertion direction, such as 60-90, such as 80-90 degrees.

The inner tool member and/or the binding head may be adapted to retain the cut end of the wire piece, by moving the inner tool member into the locking position, whereby the cut end is prevented from being retracted from the first passage. In one embodiment, the inner tool member comprise a first retaining surface and the binding head comprises a second retaining surface, and the cut end is retained in the first passage when said cut end is positioned between and in contact with the first and second retaining surface, and said surfaces are forced towards each other.

When the cut end is retained between the first and second retaining surfaces, further axial movement of the inner tool member relative to the binding head is prevented, and further rotation of the spindle causes the inner tool member and the binding head (the binding tool) to rotate together as described previously. In one embodiment, the rotation of the binding tool is caused by rotational forces applied from the thread of the spindle to the inner tool member. When the inner tool member is not positioned in the locking position, such rotational forces causes the inner tool member to be moved axially due to the thread, but when the inner tool member is positioned in the locking position, axial movement is prevented whereby the binding tool will rotate. Alternatively, or as a supplement, the inner tool member may comprise an abutment surface adapted to engage a corresponding abutment surface of the binding head when the inner tool member is positioned in its locking position, such that rotation of the inner tool member is transferred to the binding head via the abutting surfaces.

In some embodiments, the geometry of the first and the second passage causes the feed/fed end and the cut end to intersect each other whereby at least a part of the binding tool is encircled and, thus, trapped by the wire ends. As such wires may be relatively stiff, a user must apply relatively large forces to remove the binding apparatus. Accordingly in one embodiment, the inner tool member and/or the binding head is/are adapted to reshape at least one the cut end and the feed/fed end upon movement of the inner tool member away from its locking position, such that the wire ends do not intersect each other and/or such that the binding tool is not trapped by the wire ends. Upon such reshaping, the binding apparatus may be easily removed by the user.

In one embodiment, the binding apparatus comprises one or more spacers for ensuring a distance between the binding tool and the objects to be tied. The spacers provide the advantage that the tightness of the binding may be controlled, in embodiments wherein the binding tool during binding is adapted to be rotated a predetermined number of times relative to the wire path, such as one, two, three, four, five, or six. It will be appreciated that the closer the objects are to the binding tool, the tighter the binding will be and vice versa.

At least one of the spacers may define grooves/indentations adapted to receive the object to be bound. In one embodiment, the groove is defined in a surface facing the object to be bound during operation. The groove may extend in a direction transverse to the spacer e.g. such that an object received in the groove extends through axis of rotation of the spindle and the inner tool member.

In another embodiment the binding apparatus is adapted to tighten the wire as much as possible, and subsequently loosen the wire so as to provide the desired tightness of the binding.

The invention according to the first aspect may comprise one or more of the following embodiments:

Embodiment One

A binding apparatus defining a wire path for guiding a wire around one or more objects, the binding apparatus comprising: a wire supply for advancing the wire into the wire path; and a binding tool forming a passage for the wire into and out of the wire path and being rotatable relative to the wire path, and comprising: a binding head, and an inner tool member slidingly received in the binding head such that the inner tool member and the binding head are locked for relative rotation, the inner tool member being connected to a rotatable spindle such that rotation of the spindle causes the inner tool member to move, axially relative to the binding head, in the direction of a locking position in which the inner tool member is locked for axial movement relative to the binding head, whereby further rotation of the spindle causes concurrent rotation of the inner tool member and the binding head in a first direction relative to the wire path.

Embodiment Two

A binding apparatus according to embodiment one, wherein the binding head is locked for rotation in a direction opposite the first direction.

Embodiment Three

A binding apparatus according to embodiment one or two, wherein the wire supply is arranged to advance the wire through a first passage and back into a second passage via the wire path, the first and second passages being defined by the binding tool.

Embodiment Four

A binding apparatus according to any of the preceding embodiments, further comprising a cutting tool which is arranged to cut the wire during movement of the inner tool member towards the locking position.

Embodiment Five

A binding apparatus according to embodiment four, wherein the cutting tool comprises a first cutting edge which during cutting is moved towards one of a second cutting edge and a contact surface, through a substantially non-rotational movement.

Embodiment Six

A binding apparatus according to embodiment five, wherein the inner tool member defines the first cutting edge.

Embodiment Seven

A binding apparatus according to any of the preceding embodiments, wherein at least a part of the wire path is defined by one or more guiding jaws.

Embodiment Eight

A binding apparatus according to embodiment seven, wherein at least a part of the wire path is defined by a shaping tool adapted to shape the wire when advanced through the shaping tool, so as to allow the wire to be received in the second passage of the binding tool.

Embodiment Nine

A binding apparatus according to embodiment eight, wherein the shaping tool comprises at least three shape-defining surfaces which are arranged with respect to each other, such that the wire is formed so as to have with a predetermined curvature, when the wire is moved translationally into the shaping tool.

Embodiment Ten

A binding apparatus according to embodiment eight or nine, wherein the inner tool member and/or the binding head define at least one guiding surface adapted to guide the wire from the wire supply and into the shaping tool.

Embodiment Eleven

A binding apparatus according to any of embodiments eight to ten, wherein a first guiding jaw of the one or more guiding jaws is arranged to guide the wire into the shaping tool.

Embodiment Twelve

A binding apparatus according to embodiment eleven, wherein a second guiding jaw of the at least one guiding jaw is arranged to receive the wire when feed from the first guiding jaw and to guide the wire into the second passage.

Embodiment Thirteen

A binding apparatus according to any of embodiments three to twelve, wherein the inner tool member and/or the binding head comprise(s) a retainer adapted to retain a feed/fed end of the wire, upon insertion, in an insertion direction, of said end into the second passage, such that movement of the feed/fed end in a direction opposite the insertion direction is prevented.

Embodiment Fourteen

A binding apparatus according to embodiment thirteen, wherein the retainer is adapted to allow the feed/fed end to be moved in a direction transverse the insertion direction whereby the feed/fed end is moved out of engagement with the retainer.

Embodiment Fifteen

A binding apparatus according to any of the preceding embodiments, wherein the inner tool member and/or the binding head is/are adapted to retain a cut end of a wire piece which is cut from the wire and which comprises the cut end and the feed/fed end, by moving the inner tool member into the locking position, whereby the cut end is prevented from being retracted from the first passage.

Embodiment Sixteen

A binding apparatus according to any of the preceding embodiments, wherein the inner tool member comprises an abutment surface adapted to engage a corresponding abutment surface of the binding head when the inner tool member is positioned in its locking position, such that rotation of the inner tool member is transferred to the binding head via the abutting surfaces.

Embodiment Seventeen

A binding apparatus according to embodiment fifteen or sixteen, wherein the inner tool member and/or the binding head is/are adapted to reshape at least one the cut end and the feed/fed end upon movement of the inner tool member away from its locking position.

Embodiment Eighteen

A binding apparatus according to any of embodiments seven to seventeen, wherein the shaping tool is shaped such that upon tightening of the wire, the wire is brought out of engagement with the shaping tool, whereby the wire may be tightened around at least a part of the one or more objects.

In the context of the present invention, the terms feed/fed end and cut end may be substituted by the terms first end and second end, as the first end need not have been fed into the device and as the second end need not have been cut by the device. As an example the wire may be a precut piece of wire of a predetermined length. This piece of wire could have been placed around the objects to be bound by the user or by another device.

The invention according to the first aspect may comprise any combination of features and elements of the invention according to the second and/or third and/or fourth and/or fifth aspect of the invention.

In a SECOND aspect the present invention relates to a method of binding a wire around one or more objects so as to achieve a predetermined tension of the wire in the binding, the method comprising the steps of:

- placing the wire around the objects such that two pieces of the wire extend in the same direction,
- binding the wire such that a predetermined tension in the wire is achieved.

In one embodiment, the step of binding the wire comprises the step of:

- tightening the wire; and
- slackening the wire depending on the length of the tightened wire and/or the size of the objects such that:
  - the degree of slackening of the wire is the lowest, if the wire has a first length and/or the objects have a first size,
  - the degree of slackening of the wire is the highest, if the wire has a second length and/or the objects have a second size, and
  - the degree of slackening of the wire is between said lowest and highest slackening, if the wire has a third length and/or the objects has a third size,
- wherein the first length is shorter than the second length which is shorter than the third length, and
- wherein the first size is smaller than the second size which is shorter than the third size.

In one embodiment, the degree of slackening is measured in percent of the length of the wire which encirculates the objects to be bound. In another embodiment, the degree of slackening of the wire is measured in millimeters.

Accordingly in one embodiment, the step of slackening the wire comprises the step of:

- slacken the wire depending on the length of the tightened wire and/or the size of the objects such that:
  - the wire is slackened a length or percentage A, if the wire has a first length and/or the objects have a first size, the wire is slackened a length or percentage B, if the wire has a second length and/or the objects have a second size, and the wire is slackened a length or percentage C, if the wire has a third length and/or the objects have a third size, wherein A<C<B, and wherein the first length is shorter than the second length which is shorter than the third length, and wherein the first size is smaller than the second size which is shorter than the third size.

In the alternative—or as a supplement the wire may be slackened depending on the length of the tightened wire and/or the size of the objects such that:

the degree of the slackening of the wire is in a lower range, if the wire has a length which is below a first length-threshold and/or the objects have a size which is below a first size-threshold, the degree of slackening of the wire is in a middle range, if the wire has a length which is above a third length-threshold and/or the objects have a size which is above a third size-threshold, and the degree of slackening of the wire in an upper range, if the wire has a length which is between the first and third length-threshold and/or the objects have a size which is between the first and third size-threshold, wherein the first length-threshold is below the third length-threshold and the first size-threshold is below the third size-threshold, and wherein the wire is slackened less in the lower range than in the middle range and more in the upper range than in the middle range.

In one embodiment, the degree of slackening of the wire is in the middle range, if the wire has a length which is between the first and a second length-threshold and/or the objects have a size which is between the first and a second size-threshold and wherein the first length-threshold is below the second length-threshold, and the second length-threshold is below the third length-threshold, and the first size-threshold is below the second size-threshold, and the second size-threshold is below the third size-threshold.

Again, as is the case for the binding apparatus according to the first aspect, the wire—in the method—be slackened on the basis of a polynomial in which at least one indeterminate is the length of the tightened wire or the size of the objects. The polynomial may be a fourth, a fifth, a sixth, a seventh etc. degree polynomial.

Once de desired degree of slackening has been achieved, the wire may be bound. Accordingly, the method may comprise the step of: binding the wire when the desired degree of slackening has been achieved.

In one, embodiment the torque needed to bind the wire is constantly monitored during the binding process and once a predetermined torque is needed to continue the binding process, the process may be terminated. This may be done as it will be assumed that the desired tension in the binding has been reached, when the torque has reached the predetermined point.

Moreover, the wire may be bound by means of binding apparatus defining a wire path for guiding a wire around one or more objects, the binding apparatus comprising:

a wire supply for advancing the wire into the wire path; and a binding tool adapted to guide the wire into and out of the wire path, the binding apparatus comprising a retainer for retaining a front end of the wire and being rotatable relative to the wire path; and wherein the step of placing the wire comprises the step of advancing the front end of the wire into the wire path such that the wire is guided around the objects and the front end is received in the binding tool and is retained therein by the retainer.

In one embodiment, the step of binding the wire comprises the step of:

adjusting the distance from spacing elements of the binding apparatus; and tightening the wire such that a predetermined tension in the wire is achieved.

The invention according to the second aspect may comprise any combination of features and elements of the invention according to the first and/or third and/or fourth and/or fifth aspect of the invention.

In a THIRD aspect, the present invention relates to the use of a polynomial to determine the degree of slackening of a wire in a binding apparatus so as to achieve a desired/predetermined degree of tightness of the bound wire. The binding apparatus may be a binding apparatus according to the first aspect of the invention.

The invention according to the third aspect may comprise any combination of features and elements of the invention according to the first and/or second and/or fourth and/or fifth aspect of the invention.

In a FOURTH aspect, the present invention relates to a jaw for a binding tool, the jaw comprising a shaping tool for shaping a wire to have a predetermined curvature, the shaping tool comprising at least three shape-defining surfaces which are arranged with respect to each other, such that a wire which is moved translationally into the shaping tool is reshaped so as to define a predetermined curvature.

The jaw tool according to the second aspect of the invention may comprise any feature or element according to the first aspect of the invention. As an example, the shaping tool may be shaped such that upon tightening of a wire received in the tool, the wire is brought out of engagement with the shaping tool.

The fourth aspect of the invention may comprise one or more of the following embodiments:

Embodiment Nineteen

A jaw for a binding tool, the jaw comprising a shaping tool for shaping a wire to have a predetermined curvature, the shaping tool comprising at least three shape-defining surfaces which are arranged with respect to each other, such that a wire which is moved translationally into the shaping tool is reshaped so as to define a predetermined curvature.

Embodiment Twenty

A jaw according to embodiment nineteen, wherein the shaping tool is shaped such that upon tightening of the wire, the wire is brought out of engagement with the shaping tool.

The invention according to the fourth aspect of the invention may comprise any combination of features and elements of the first and/or second and/or third and/or fifth aspect of the invention.

The invention according to the fourth aspect may comprise any combination of features and elements of the invention according to the first and/or second and/or third and/or fifth aspect of the invention.

In a FIFTH aspect the present invention relates to a binding apparatus defining a wire path for guiding a wire around one or more objects, the binding apparatus comprising:

a wire supply for advancing the wire into the wire path; and a binding tool forming a passage for the wire into and out of the wire path and being rotatable relative to the wire path, wherein the wire supply comprises a sensor for determining a length of at least a part of the wire.

The binding apparatus may be adapted to prevent a binding action if the wire of the wire supply is shorter than a predetermined length, such as a minimum wire-length required for a binding action. In one embodiment, the apparatus is adapted to signal to a user that the wire of the wire supply does not have the specified length to perform a binding action. The signal may be an audio signal and/or a visual signal and/or a tactile signal.

The fifth aspect of the invention may comprise the one or more of the following embodiments:

Embodiment Twenty One

A binding apparatus defining a wire path for guiding a wire around one or more objects, the binding apparatus comprising:

a wire supply for advancing the wire into the wire path; and a binding tool forming a passage for the wire into and out of the wire path and being rotatable relative to the wire path, wherein the wire supply comprises a sensor for determining a length of at least a part of the wire.

Embodiment Twenty Two

A binding apparatus according to embodiment twenty one, wherein the binding apparatus is adapted to prevent a binding action if the wire of the wire supply is shorter than a predetermined length.

Embodiment Twenty Three

A binding apparatus according to embodiment twenty two, wherein the predetermined length is a minimum wire-length required for a binding action.

The invention according to the firth aspect may comprise any combination of features and elements of the invention according to the first and/or second and/or third and/or fourth of the invention.

BRIEF DESCRIPTION OF THE FIGURES

The invention will now be described in further detail with reference to the drawings in which.

DETAILED DESCRIPTION OF THE FIGURES

Figure 1:
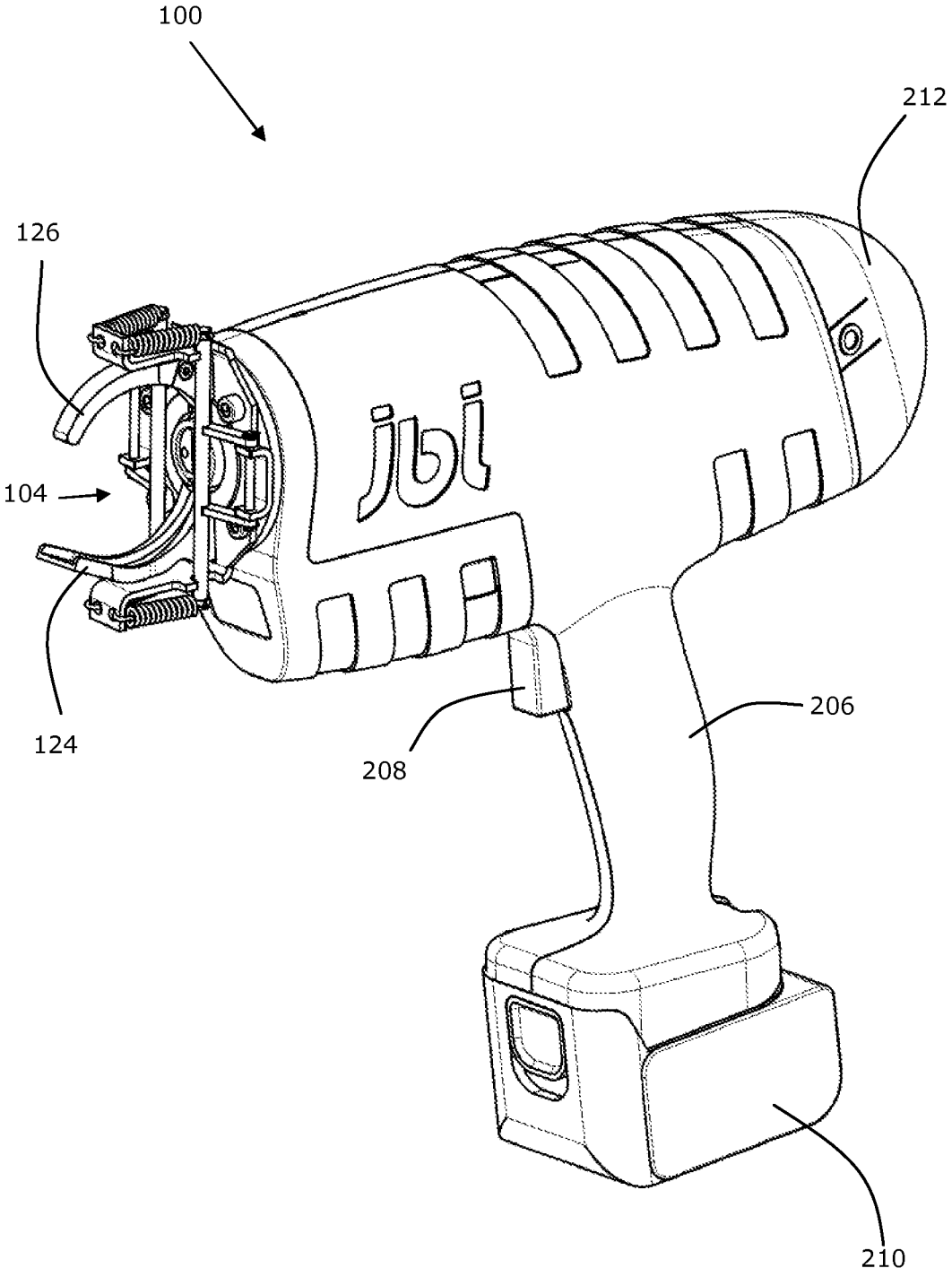
FIG. 1 discloses a binding apparatus according to the present invention.
Figure 2A:
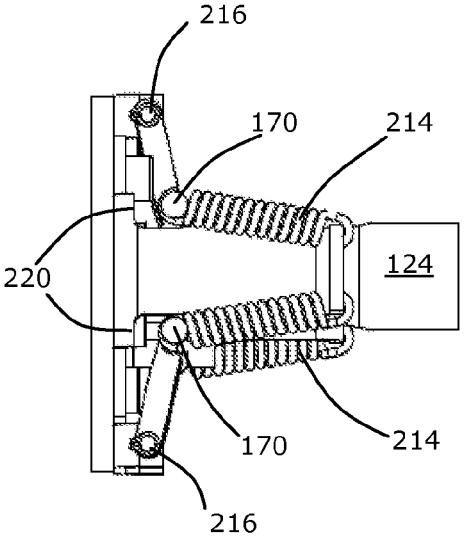
FIGS. 2*a*-2*d* disclose a resilient space defining element.
Figure 2C:
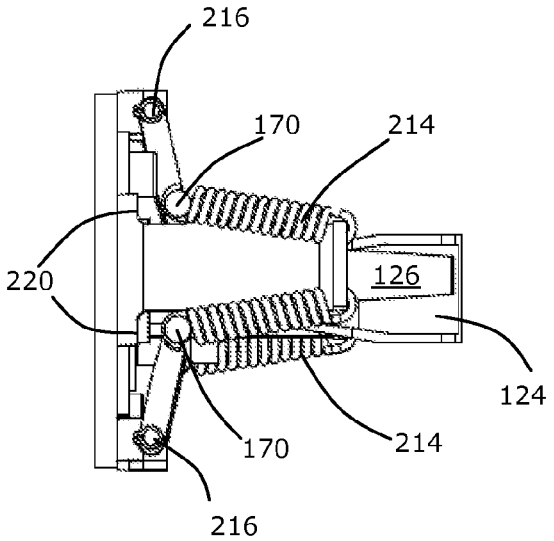
Figure 2B:
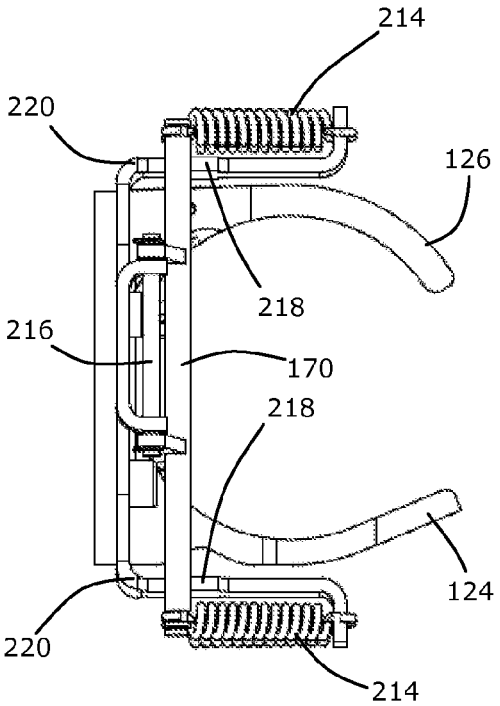
Figure 2D:
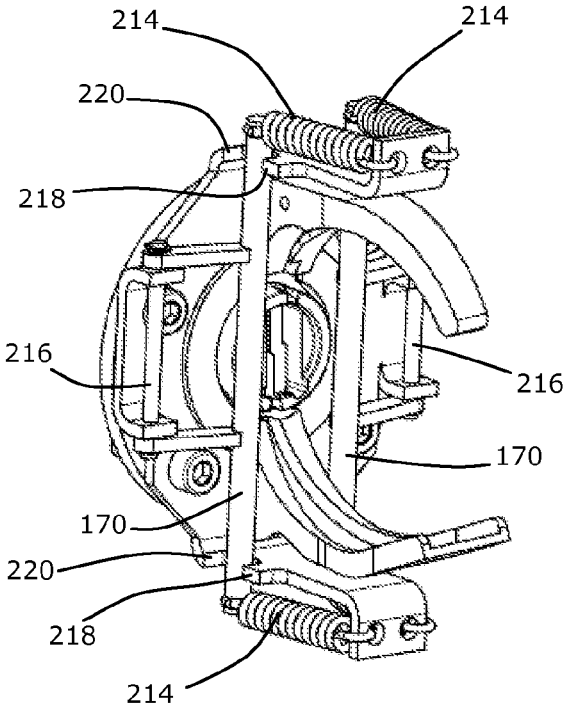

FIG. 1 discloses a binding apparatus 100 according to the present invention. The binding apparatus comprises a handle 206, an activation button 208 and a battery pack 210. During use, a user operates the apparatus 100 by holding the handle 206 in the hand such that the index finger is able to press the activation button 208. When the activation button 208 is pressed towards the handle 206, the apparatus 100 initiates the binding process. The wire (not shown) is provided in the rear part of the apparatus 100 such that it is protected by the wire cover 212. The binding apparatus 100 comprises a binding tool 104 which is described in further detail in relation to FIG. 4-10.

The binding tool comprises a one or more space defining elements 170. In the embodiments of FIGS. 2*a*-2*d* and 14*a*-14*d*, the binding apparatus 100 comprises two space defining elements 170, however it will be appreciated that any number of space defining elements 170 may be provided. The space defining elements 170 are adapted to space the objects 130 apart from the binding tool 104. The objects 130 and the binding tool 104 are illustrated in FIGS. 4-10. The space defining elements 170 are adapted to vary the distance from the objects 130 to the binding tool 104 in response to the torque transferred from the binding tool 104 to the wire 118 during binding and/or the axial tension in the wire 118 during binding and/or the axial pressure exerted on the space defining elements 170 during binding.

In the embodiment of FIGS. 2*a*-2*d*, resilient elements 214 in the form of springs are arranged to bias the space defining elements 170 towards a distal position. In all of the FIGS. 2*a*-2*d*, the space defining elements 170 are illustrated in their distal position. In FIGS. 2*a*-2*d*, the space defining elements are pivotally arranged by means of hinges 216. Due to the pivotal arrangement, the space defining elements 170 are moveable between a distal position in which the space defining elements 170 abut a distal protrusion 218 and a proximal position in which the space defining element 170 abuts a proximal protrusion 220. Due to the provision of the resilient element 214, the space defining element is biased towards the distal position. It will be appreciated that the larger the force acting on the space defining elements 170 during binding is, the more the space defining elements are forces away from the distal position and towards the proximal position i.e. in the direction of the binding apparatus—see FIG. 1. It will also be appreciated that the larger the spring constant of the resilient element is the larger must be the force which is needed to bias the space defining element away from the distal position.

Figure 3C:
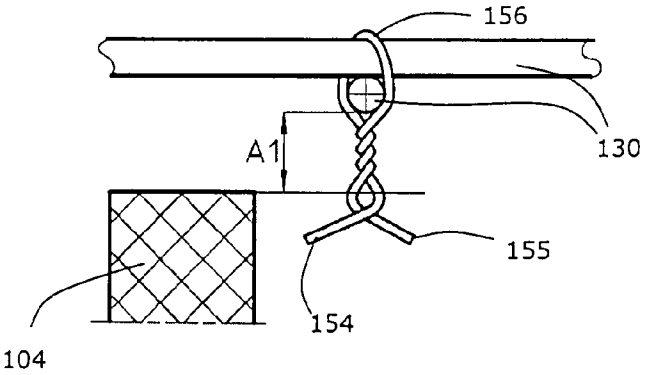
FIGS. 3*a*-3*d* illustrate the effect of a resilient space defining element, FIG. 4 discloses a binding apparatus prior to operation, FIGS. 5-8 disclose the process of feeding the wire into and around objects to be bound, FIGS. 9-11 disclose the process of binding the wire, FIG. 12 discloses removal of the binding apparatus, FIG. 13 discloses a wire supply according to the invention, FIGS. 14*a*-14*d* disclose a binding apparatus comprising spacers, and FIG. 15 discloses a graph illustrating the degree of slackening of the wire as a function of the length of the wire and/or the size of the objects to be bound.
Figure 3D:
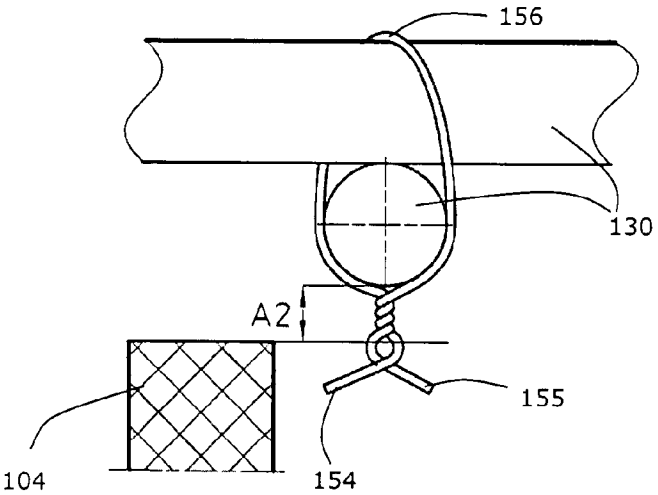
Figure 3A:
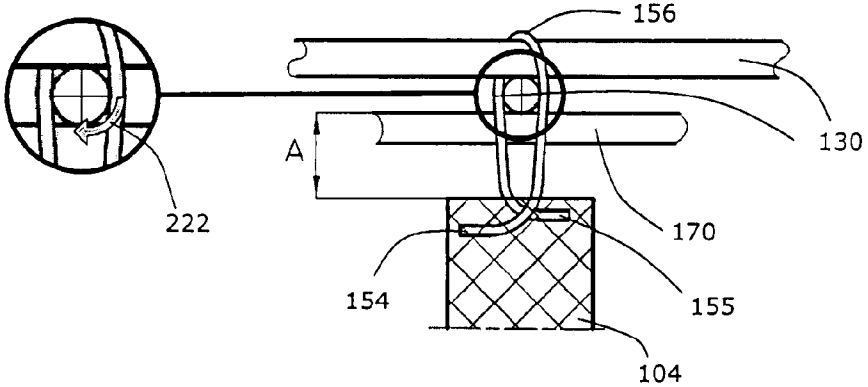
Figure 3B:
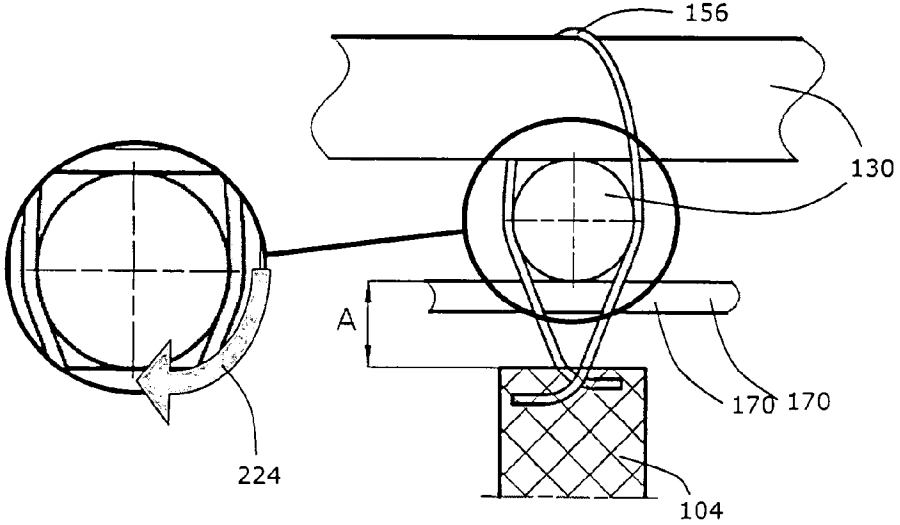

The binding process is illustrated in FIGS. 3*a*-3*d*, FIGS. 3*a* and 3*b* illustrate the point in time in binding process in which the wire piece 156 has been guided around the reinforcing bars 130 and is ready to be twisted, thus these Figs. correspond to FIG. 9 in the below description of the binding process. FIGS. 3*c* and 3*d* illustrate the point in time in the binding process in which the wire ends have been twisted around each other. Thus the latter two figures correspond to FIG. 10 in the below description of the binding process. Moreover, FIGS. 3*a* and 3*c* illustrate a situation in which the reinforcing bars are relatively thin e.g. 6 mm thick, whereas FIGS. 3*b* and 3*d* illustrate a situation in which the reinforcing bars are relatively thick e.g. 20 mm thick.

Initially (FIGS. 3*a* and 3*b*), the space defining element 170 is provided in its distal position in which the distance from the binding tool 104 to the nearest reinforcing bar 130 is 'A'. In this situation the wire ends must be bent around the circumference of the reinforcing bars in order for them to meet during binding. This is illustrated by arrows 222 and 224. It will be appreciated that the circumferential distance —indicated by arrow 224—is longer on the thick bar in FIG. 3*b* than in the circumferential distance—indicated by arrow 222—of thin bar 130 in FIG. 3*a*. Accordingly when the wire has been bent around the circumference, the remaining part of the wire which can be used for twisting the wire ends, may not be sufficiently long to allow the wire ends to be twisted the predetermined number of times, i.e. two times in the embodiment of FIGS. 3*c* and 3*d*. This is especially the case with thicker bars where the circumferential distance is longer.

As the binding apparatus 100 is programmed to twist the wire a predetermined number of times, the axial tension in the wire piece 156 is larger when the reinforcing bars 130 are thick (FIG. 3*b*) than when the reinforcing bars 130 are thin. The effect is that the resilient space defining elements 170 is compressed more during binding when the reinforcing bars are thick than when they are thin. This compression allows for a larger part of the wire to be twisted whereby the predetermined number of twists may be achieved. The result is that the binding tool 104 is moved closer to the reinforcing bars 130 during binding of wider bars relative to binding of thinner bars. This is illustrated by the distances 'A1' and 'A2' in FIGS. 3*c* and 3*d*. In FIGS. 3*c* and 3*d* the space defining elements are not illustrated for simplicity reasons.

From the above it will be appreciated that the provision of resilient space defining elements provides a solution to the problem of ensuring that the wire piece 156 has the desired tension—i.e. not too loose and not so tight that the wire piece breaks, when it has been twisted a predetermined number of times.

FIGS. 4-12 disclose a binding apparatus 100 defining a wire path and comprising a wire supply 160 (cf. FIG. 13), a rotatable spindle 102, and a binding tool 104. The binding tool 104 comprises a binding head 106 and an inner tool member 108 which is slidingly received in the binding head 106 such that the inner tool member 108 and binding head 106 are locked for relative rotation of one relative to the other.

The inner surface (not shown) of the inner tool member 108 is threaded and engages a threaded outer surface 110 of the spindle 102, such that rotation of the spindle 102 causes the inner tool member 108 to move axially (to the right in the drawing) relative to the binding head 106 and towards a locking position (shown in FIG. 10) in which the inner tool member 108 is locked for axial movement relative to the binding head 106 whereby further rotation of the spindle 102 causes concurrent rotation of the inner tool member 108 and the binding head 106.

The binding apparatus 100 further comprises a cutting tool 112 comprising a first cutting edge 114 and a contact surface 116. The first cutting edge 114 and the contact surface 116 are arranged to perform a cutting action when the first cutting edge 114 slides past the contact surface 116. During said cutting action, the first cutting edge 114 is forced in the direction indicated by arrow 117, such that a wire 118 feed into a first passage 120 is forced into contact with the contact surface 116 which prevents the wire 118 from moving in the direction of arrow 117, whereby further movement of the first cutting edge 114 courses the wire 118 to be cut.

The wire supply 160 (cf. FIG. 13) is arranged to supply the wire 118 through the first passage 120 and back into a second passage 122 via a first guiding jaw 124 and a second guiding jaw 126. At least a part of the wire path is defined by the first and second guiding jaws (124,126). The first and second guiding jaws 124,126 together define a cavity 128 wherein one or more objects 130, such as reinforcing bars, may be positioned so as the bind the one or more objects 130 together by means of the binding apparatus 100. In order to allow the objects to be positioned in the cavity 128, a part of the wire path is "broken", such that when the wire 118 is not feed from the first to the second guiding jaw 124,126, the objects 130 may be moved into the cavity 128, and such that when the wire 118 is feed from the first guiding jaw 124 to the second guiding jaw 126, the objects 130 cannot be moved into or out of the cavity 128 as the wire 118 prevents such movement.

Moreover, the first guiding jaw 124 comprises a shaping tool 132 adapted to shape/bend the wire 118 when feed through a passage 134 of shaping tool 132. The shaping tool 132 is adapted to shape/bend the wire 118 to have a curvature allowing the wire 118 when feed from the first guiding jaw 124 to be received by the second guiding jaw 126 and further into the second passage 122.

Figure 4:
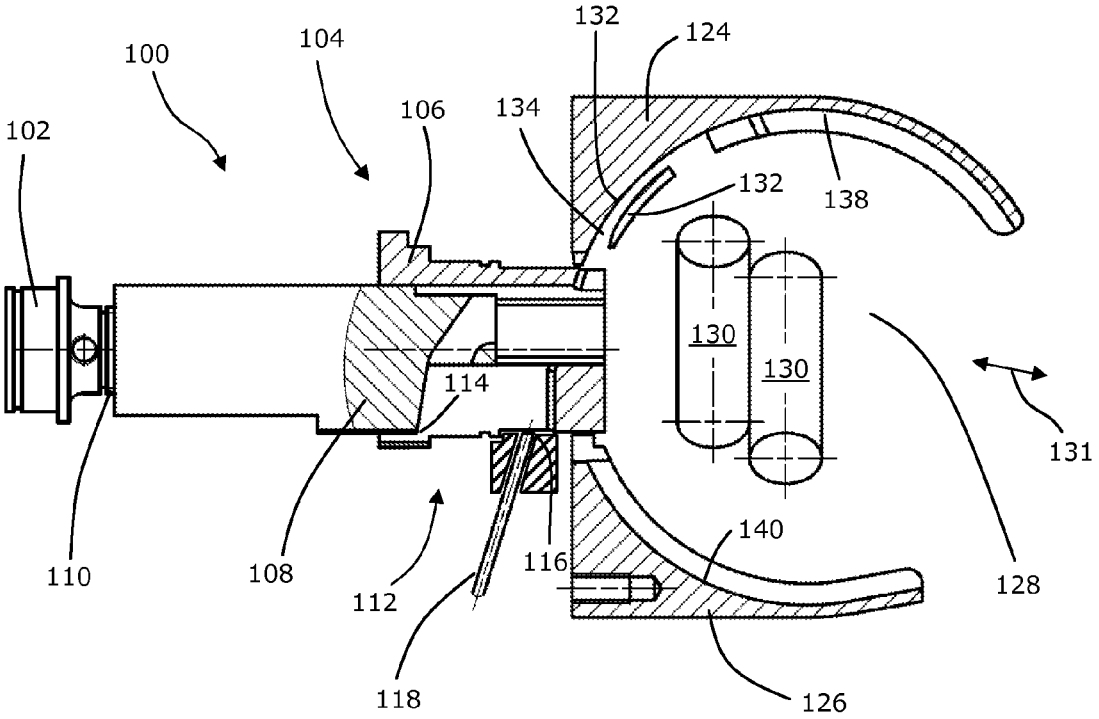

In FIG. 4 discloses an initial position wherein the first and second guiding jaws 124,126 are positioned around the objects 130 such that the objects are positioned in the cavity 128. The inner tool member 108 is positioned in an initial position, wherein it is retracted relative to the binding head 106 (i.e. positioned to the left in the drawing). The wire 118 abuts the second cutting edge 116 and is ready for insertion into the first passage 120, cf. FIG. 4.

Figure 5:
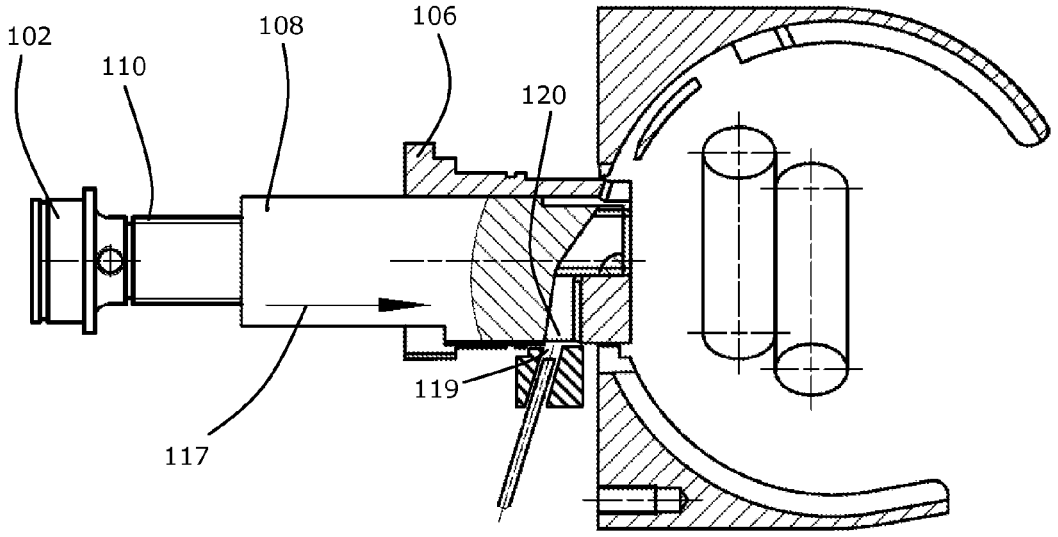
Figure 10:
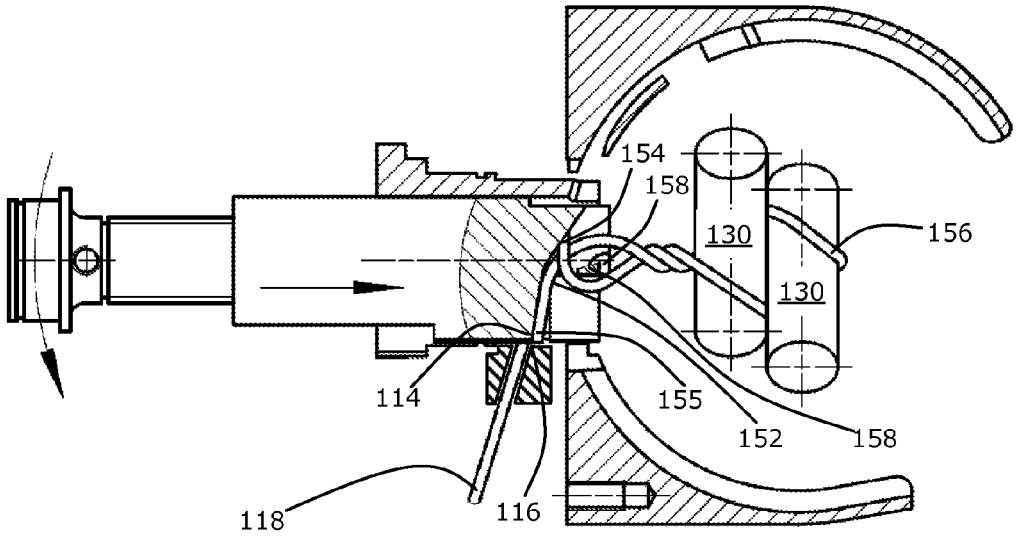

In FIG. 5 the spindle 102 is rotated in a first rotational direction whereby the threaded engagement between the outer surface of the spindle 102 and the inner surface of the inner tool member 108 causes the inner tool member 108 to be moved axially (i.e. to the right in the drawing) relative to the binding head 106 and in the direction of (but not into) a locking position (cf. FIG. 10). In order to prevent the binding head 106 from rotating with the spindle 102, the binding head 106 is partially locked for rotation relative to the wire path. The partial lock is adapted to prevent said relative rotation, as along as a torque applied to the binding head is below a predetermined threshold and has a direction opposite the first rotational direction. Accordingly, if the torque is above the predetermined threshold and in the direction of the first rotational direction, the binding head 106 may be rotated. Accordingly, the inner tool member is in its locking position, rotation of the spindle 102 cannot be transformed into translational movement of the inner tool member, whereby the torque needed to rotate the spindle 102 must exceed said predetermined threshold in order to allow the spindle to be rotated further. This is described in further detail in relation to FIG. 10.

Figure 6:
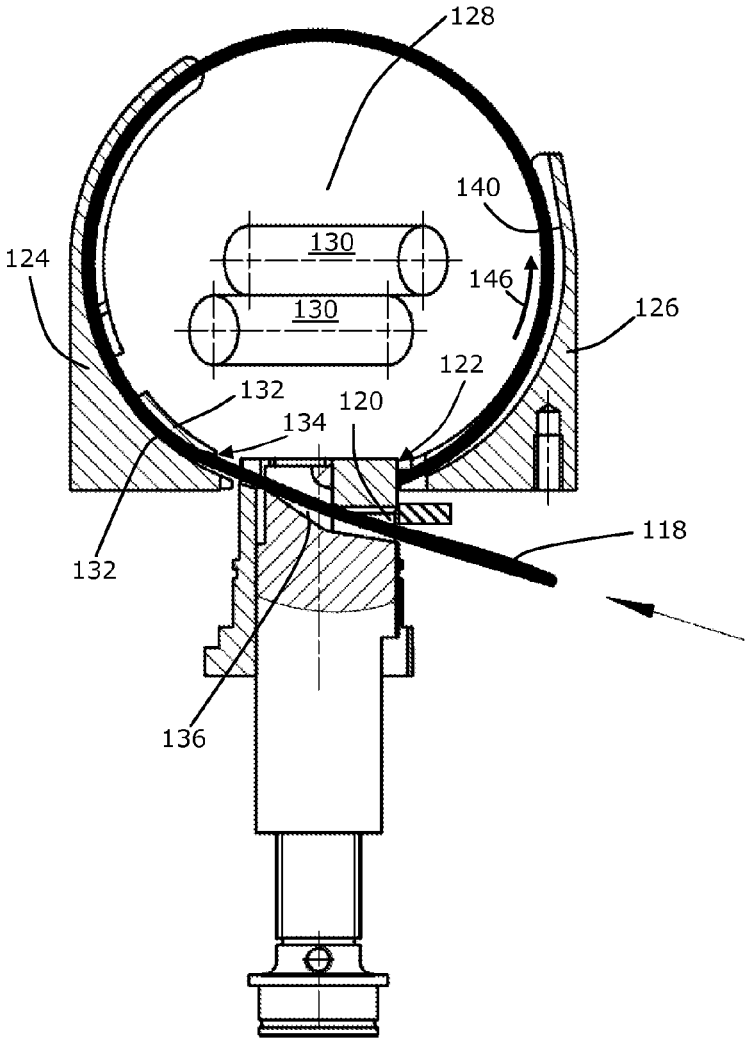
Figure 7:
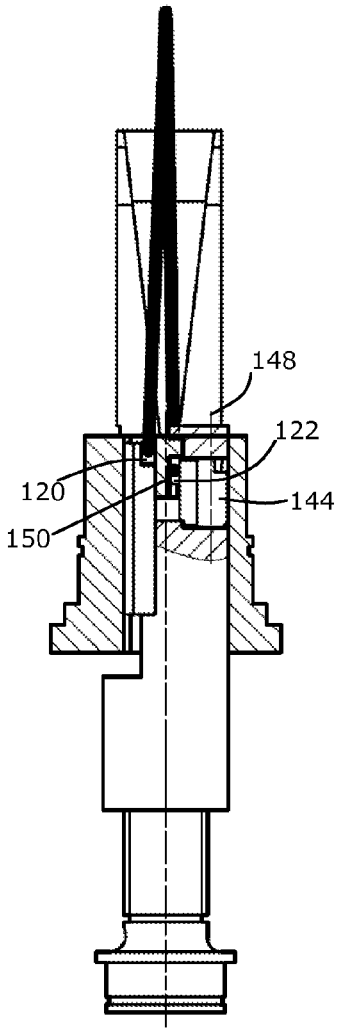
Figure 8:
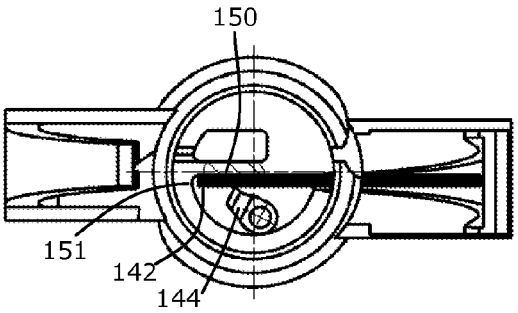
Figure 13:
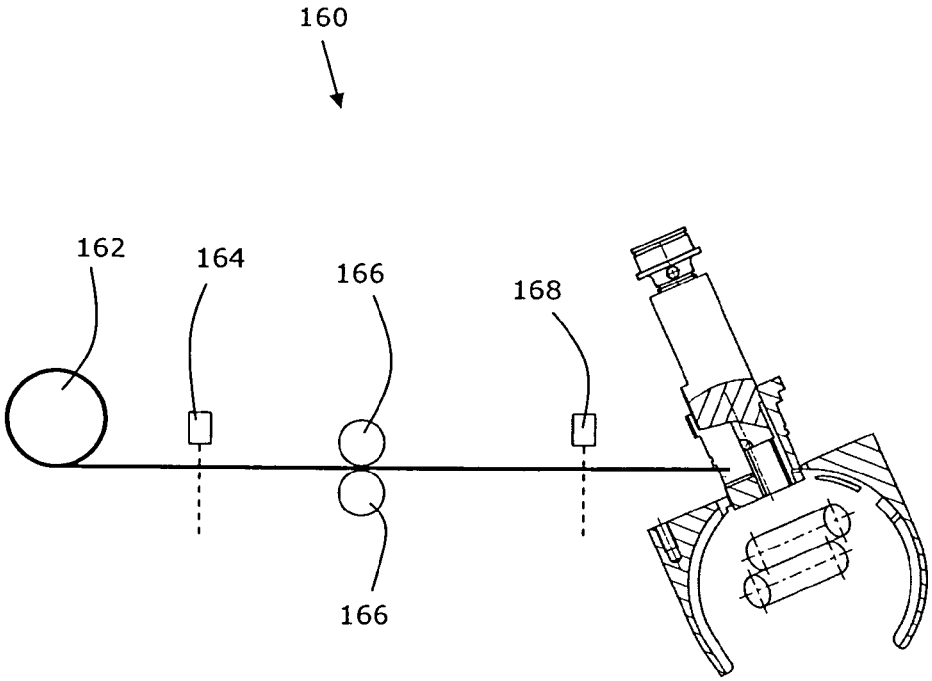
Figure 14A:
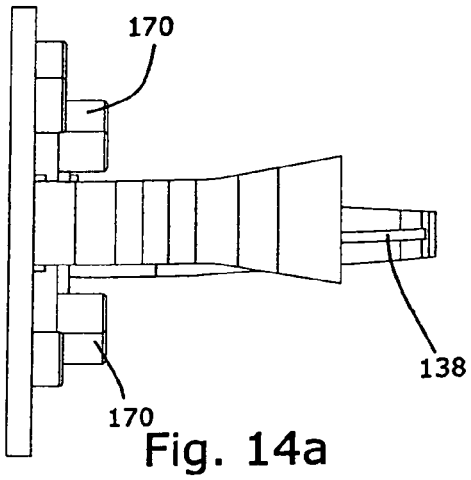
Figure 14B:
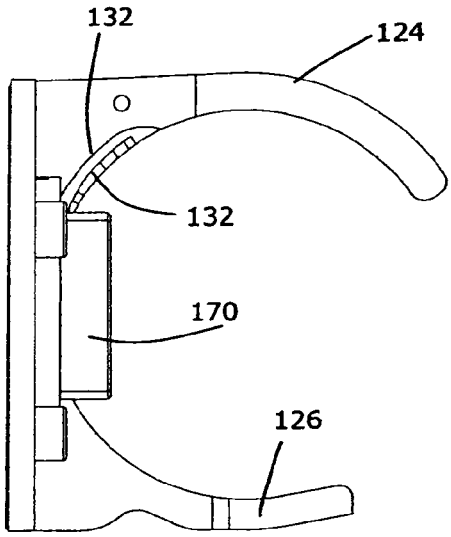
Figure 14D:
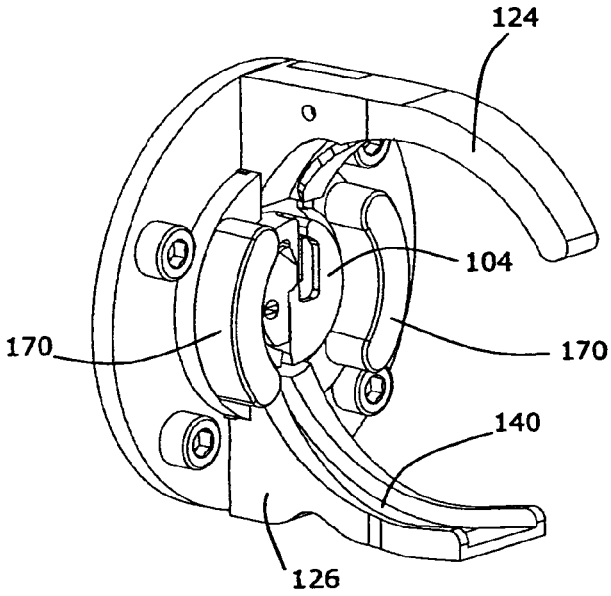
Figure 14C:
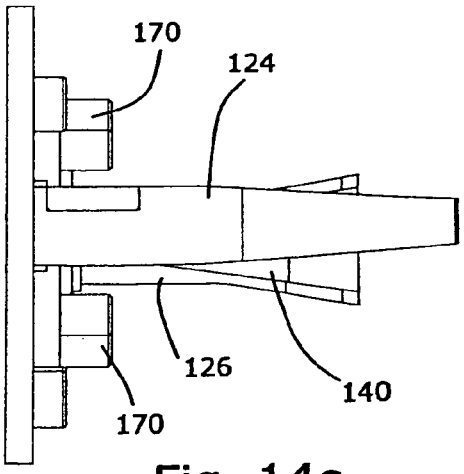

In FIGS. 6-8 the wire supply 160, which is described in relation to FIG. 13, advances the wire 118 into the first passage 120 wherein a guiding surface 136 guides the wire 118 into the passage 134 of the shaping tool 132 which shapes/bends the wire 118 to have a curvature corresponding to the curvature of the first and second guiding jaws 124,126. Subsequently, the wire 118 follows a first guiding surface 138 of the first guiding jaw 124. Due to the reshaping of the wire 118 provided by the shaping tool 132, the wire 118 is received by the second guiding jaw 126, and slides along a second guiding surface 140 of second guiding jaw 126 until the wire 118 is received in the second passage 122. Upon further feeding of the wire 118, the wire end 142 is moved into engagement with a retainer in the form of a pawl 144 which locks the wire for movement in the reverse direction as indicated by arrow 146. The pawl 144 is pivotable about a retainer axis 148 and a spring (not shown) urges the pawl 144 towards the sidewall 150. The wire end 142 is retained between the pawl 144 and the sidewall 150 and reverse movement of the wire (in the direction of the arrow 146) urges the retainer towards the wire and the sidewall. The wire 118 is prevented from further advancement into the second passage 122 when a feed/fed end 154 abut a stopping surface 151, and the wire supply 160 halts the feeding process, as is described in relation to FIG. 13.

Figure 9:
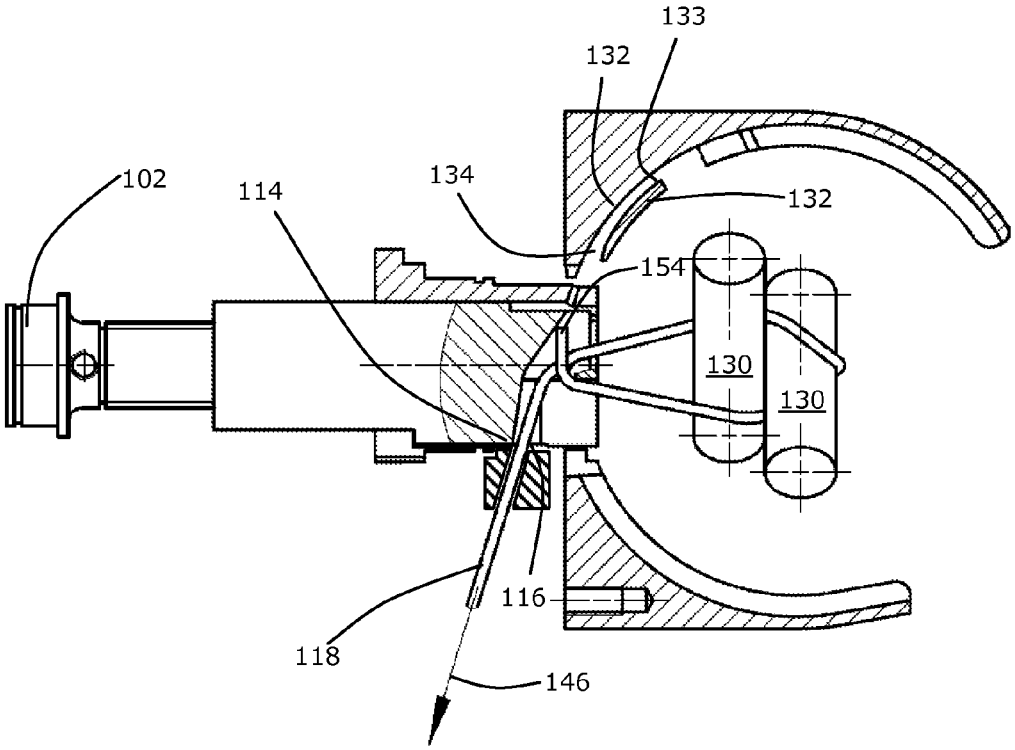

In FIG. 9 the wire supply 160 pulls the wire 118 in the reverse direction, as indicated by arrow 146. This tightens the wire 118, whereby the wire 118 is pulled out of the passage 134 of the shaping tool 132 and is tightened around a part of the objects 130. In order to achieve this, the shaping tool 132 may be open in one side, i.e. in a direction into or out of FIG. 9. Moreover, a downstream surface 133 of the shaping tool may be designed to force the wire 118 towards the open side upon tightening of the wire 118. With the wire 118 tightened around the reinforcing bars 130, the spindle 102 is rotated whereby the inner tool member 108 is moved into its locking position as illustrated in FIG. 10. During said movement the wire 118 is cut by the first cutting edge 114 and the contact surface 116, whereby a wire piece 156 is produced, said wire piece 156 has a feed/fed end 154 and a cut end 155. When the inner tool member 108 is positioned in the locking position, the wire 118 is retained between the inner tool member 108 and the abutment surface 152. With the inner tool member 108 in its locking position, further rotation of the spindle 102 causes the inner tool member 108 and binding head 106 to rotate, when the torque applied to the spindle exceeds the predetermined threshold. Upon said rotation, the wire is twisted as the feed/fed end 154 and the cut end 155 are retained in the binding tool 104.

Figure 11:
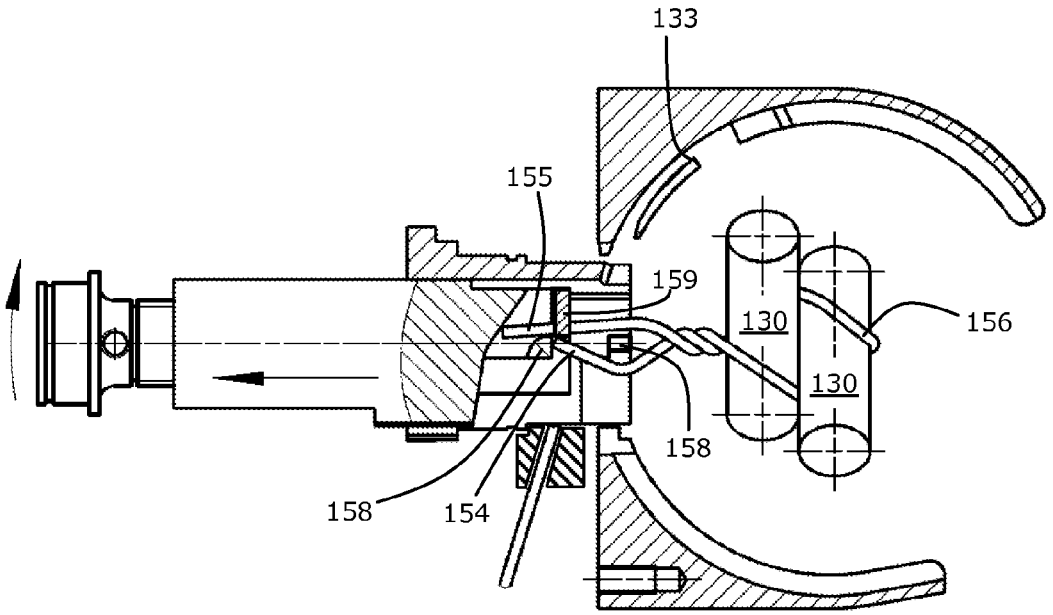
Figure 12:
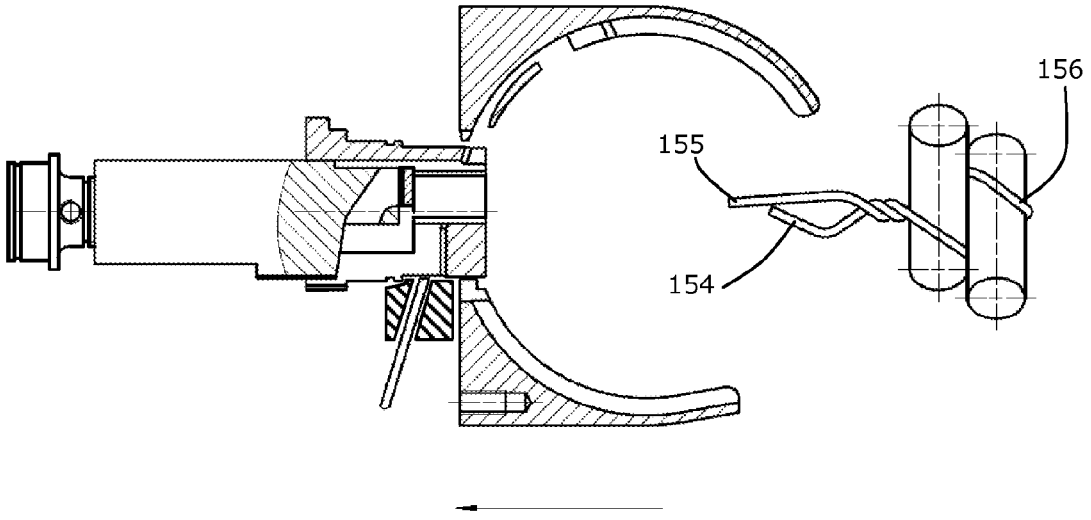

With the objects 130 bound to each other, the spindle 102 is rotated in the opposite direction as illustrated in FIG. 11. As the binding head 106 is prevented from rotating in the opposite direction, rotation of the spindle in said direction causes the inner tool member 108 to be moved away from its locking position, whereby the ends 154,155 of the wire piece 156 are straightened out due to the elements 158,159. Subsequently the binding apparatus 100 may be removed as shown in FIG. 12.

An embodiment of the wire supply 160 is illustrated in FIG. 13. The wire supply 160 comprises a wire coil 162, a first sensor 164, feeding rollers 166 and a second sensor 168. When the wire supply 160 is empty, the wire 118 may be feed into the wire supply 160, so as to allow the wire 118 to be received by the feeding rollers 166. Prior to receipt of the wire 118 by the rollers 166, the first sensor 164 detects the presence of a wire 118, whereby a motor (not shown) causes the rollers to rotate. When the wire 118 is received by the rollers 166, the rollers are rotated until the wire 118 is detected by the second sensor 168 and the further advancement of the wire is halted, when the free end is in the correct feeding position.

Upon initiation of a user of the binding apparatus, the motor is operated whereby the rollers rotate and the wire 118 is feed via the wire path into the second passage 122 as described above. When the wire end abuts the stopping surface 151 of the second passage the wire is prevented from being advanced further and the current in the electrical circuit connected to the motor increases. Accordingly, when the control system controlling the motor detects such an increase in the current, the rotational direction of the motor (rollers) are reversed in order to tighten the wire as described in relation to FIG. 9. In an alternative embodiment, the number or revolutions of the rollers are used to determine whether the wire has been advanced sufficiently to be received in the second passage 122.

The binding apparatus comprises a revolution counter adapted to count the number of revolutions made by the feeding rollers 166. As one revolution of the feeding rollers 166 corresponds to a predetermined length of wire 118, the revolution counter is adapted to output a signal corresponding to a wire length.

The apparatus 100 is adapted to be operated as follows: If during feeding of wire 118 the first sensor 164 is no longer able to detect the wire 118 i.e. the wire supply is empty, the apparatus is, by means of the revolution counter, be adapted to determine the length of the wire 118 which, in connection with the current binding action, has already been feed by means of the rollers 166. If said length is below a predetermined length e.g. the length needed to perform a binding action, the binding apparatus is adapted to retract the feed wire 118 and signal to the user, that the wire 118 is not long enough for binding and that a new wire should be inserted into the wire supply.

FIGS. 14*a*-14*d* disclose a binding apparatus 100 comprising two spacers 170, which during binding are used to provide a predetermined distance between the objects and the binding head. By providing a predetermined distance the tightness of the bindings may be controlled, as it will be appreciated that the longer the distance is the more loose the binding is, and the shorter the distance is the tighter the binding is, for the same size of objects 130. Accordingly, a user may advance the binding apparatus into a position wherein one or more of the objects 130 abut the spacers 170, whereby the predetermined distance between the binding tool 104 and the objects 130 is ensured.

In a first embodiment the axial extent of the spacers is adjustable. The adjustability may be ensured by providing a plurality of interchangeable sets of spacers each having different lengths. Alternatively, the spacers may be adapted to be moved axially between two positions between which the spacers may be positioned in order to achieve the desired tightness of the bindings. The user may adjust the adjustable spacers manually or automatically by means of a motor.

In a second embodiment the spacers are provided in a predetermined length and the tightness of the binding is controlled by adjusting the tightening of the wire either manually or automatically. In order to control the tightening of the wire the apparatus may be adapted to tighten the wire as much as possible and subsequently loosen the wire in order to achieve the desired tightness. The apparatus may be adapted to allow the user to adjust the tightening/loosening of the wire manually or automatically. The latter may be achieved by the following steps which the apparatus may be adapted to carry out:

In a first step, a predetermined length of wire is advanced out though the binding head. When the wire end is received by the wire head after having been guided around the objects 130, the wire end is retained and the wire is tightened by retracing the wire as much as possible.

In a second step, the length of the retracted part of the wire is determined (i.e. it is determined how much wire can be retracted until the wire is as tight as possible). It will be appreciated that the longer the retracted wire is the smaller the objects are, and the shorter the retracted wire is the larger the objects are. Thus, the apparatus may be adapted to determine how much the wire need to be loosened in order to ensure a desired tightness of the binding for any size of the object(s).

In a third step the wire is loosened in order to ensure the desired tightness of the binding.

Figure 15:
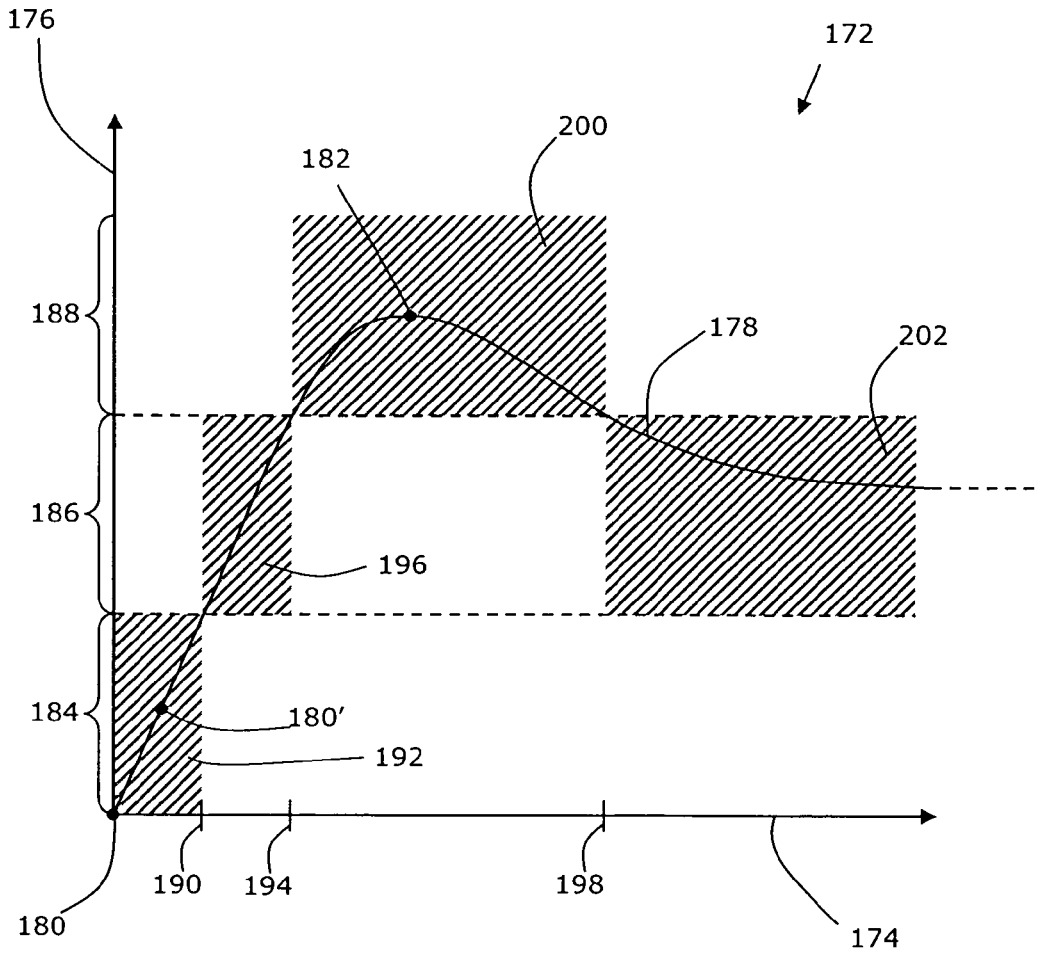

FIG. 15 illustrates a graphical representation 172 of the slackening of the wire. The first axis 174 is a representation of the length of the wire 118 and/or the size of the object 130 and the second axis 176 is a representation of the degree of slackening. Thus, the graph 178 represents the degree of slackening of the wire as a function of the length of the wire 118 and/or the size of the objects 130.

FIG. 15 illustrates two embodiments (which may be combined). In the first embodiment, the degree of slackening of the wire 118 is the lowest, when the wire 118 has a first length and/or the objects 130 have a first size—this is illustrated by the point 180. In some cases, the apparatus specifies a minimum length of the wire which is illustrated by point 180'. In such cases, the apparatus cannot perform a binding in which the wire length is below said minimum length.

Moreover the first embodiment, the degree of slackening of the wire 118, is the highest, when the wire 118 has a second length and/or the objects 130 have a second size. This is illustrated by point 182.

In the first embodiment, the degree of slackening of the wire 118 is between said lowest and highest slackening (point 180/180' and 182, respectively), if the wire 118 has a third length and/or the objects (130) have a third size.

It will be appreciated from FIG. 15 that the third length/size may be represented on the graph 178 as any position on the graph 178 which is different from the points 180/180' and 182. Accordingly, the point may be a point between the points 180/180' and 182 or a point to the right of the point 182. In a second embodiment of FIG. 15, a lower range 184, a middle range 186 and an upper range 188 are defined.

The wire is slackened such that the degree of the slackening of the wire 118 is in the lower range 184, if the wire 118 has a length which is below a first length-threshold 190 and/or the objects (130) have a size which is below a first size-threshold 190. This is illustrated by a lower hatched-area 192.

Moreover, the degree of slackening of the wire 118 is in the middle range 186, if the wire 118 has a length which is between the first length-threshold 190 and a second length-threshold 194 and/or the objects have a size which is between the first size-threshold 190 and a second size-threshold 194. This is illustrated by first middle-hatched-area 196.

Additionally, the degree of slackening of the wire 118 in the upper range 188, if the wire 118 has a length which is between the second length-threshold 194 and a third length-threshold 198 and/or the objects have a size which is between the second size-threshold 194 and third size-threshold 198. This is illustrated by an upper-hatched-area 200.

Finally, the degree of slackening of the wire 118 is in the middle range 186, if the wire 118 has a length which is above the third length-threshold 198 and/or the objects have a size which is above the third size-threshold 198. This is illustrated by a second middle hatched area 202.

The invention claimed is:

1. A method of binding a wire around one or more objects so as to achieve a predetermined tension of the wire in the binding, the method comprising the steps of:

advancing a front end of the wire into a wire path thereby guiding and placing a length of the wire around the objects such that two parts of the wire extend in the same direction, determining the length of the advanced wire, binding the wire such that a predetermined tension in the wire is achieved, wherein the step of binding the wire comprises the step of:

tightening the wire by retracting the wire;

determining the length of the retracted wire and thereby the length of the tightened wire, and slackening the wire a length in dependence on the length of the tightened wire such that:

the wire is slackened a predetermined length A, if the length of the tightened wire is below a first length-threshold T1, the wire is slackened a predetermined length B, if the length of the tightened wire is above a second length-threshold T2 and below a third length-threshold T3, the second and third length-thresholds being greater than the first length-threshold T1, and the wire is slackened a predetermined length C, if the length of the tightened wire is above the third length-threshold T3, wherein the length C is larger than the length A but smaller than the length B.

2. The method according to claim 1, wherein the wire is slackened the predetermined length C, if the length of the tightened wire is between the first T1 and the second length-threshold T2.

3. The method according to claim 1, wherein the length A, B, or C are determined as a polynomial function of at least the length of the tightened wire.

4. The method according to claim 3, wherein the polynomial function is at least a fourth degree polynomial.

5. The method according to claim 1, further comprising the step of:

binding the wire upon the step of slackening the wire.

6. The method according to claim 1, wherein the wire is bound by means of a binding apparatus defining the wire path for guiding the wire around the one or more objects, the binding apparatus comprising:

a wire supply for advancing the wire into the wire path; and a binding tool configured to guide the wire into and out of the wire path, the binding apparatus further comprising a retainer for retaining a front end of the wire and being rotatable relative to the wire path; and wherein the step of placing the wire around the objects comprises the step of advancing the front end of the wire into the wire path such that the wire is guided around the objects and the front end is received in the binding tool and is retained therein by the retainer.

7. The method according to claim 6, wherein the binding apparatus comprises one or more space defining elements configured to space the objects apart from the binding tool, and wherein the step of binding the wire further comprises the step of moving the space defining elements of the binding apparatus such as to adjust the distance between the binding tool and the objects.

* * * * *